US008894103B2

(12) United States Patent
Shibayama et al.

(10) Patent No.: US 8,894,103 B2
(45) Date of Patent: Nov. 25, 2014

(54) VEHICLE DOOR OPENING-CLOSING DEVICE

(75) Inventors: Satoshi Shibayama, Nagoya (JP); Toshio Machida, Toyota (JP); Satoshi Takeno, Nishio (JP); Emiko Okuma, Novi, MI (US)

(73) Assignees: Aisin Seiki Kabushiki Kaisha, Kariya-Shi, Aichi-Ken (JP); Aisin Technical Center of America, Inc., Plymouth, MI (US)

( * ) Notice: Subject to any disclaimer, the term of this patent is extended or adjusted under 35 U.S.C. 154(b) by 157 days.

(21) Appl. No.: 13/538,096

(22) Filed: Jun. 29, 2012

(65) Prior Publication Data

US 2014/0001771 A1 Jan. 2, 2014

(51) Int. Cl.
*E05C 3/06* (2006.01)

(52) U.S. Cl.
USPC ..... 292/201; 292/216; 292/DIG. 23

(58) Field of Classification Search
CPC ..... E05B 81/00; E05B 81/20
USPC ..... 292/100, 201, 216, DIG. 23, DIG. 42
See application file for complete search history.

(56) References Cited

U.S. PATENT DOCUMENTS 5,520,425 A 5/1996 Dowling
7,390,034 B2 * 6/2008 Inoue ..... 292/10
7,540,541 B2 * 6/2009 Yoneyama et al. ..... 292/216
8,061,742 B2 11/2011 Machida et al.
2008/0105011 A1 * 5/2008 Machida et al. ..... 70/237
2009/0267359 A1 10/2009 Takayanagi et al.
2010/0026014 A1 * 2/2010 Machida et al. ..... 292/216

FOREIGN PATENT DOCUMENTS

JP 2010-031569 A 2/2010

* cited by examiner

*Primary Examiner* — Kristina Fulton
*Assistant Examiner* — Christine M Mills
(74) *Attorney, Agent, or Firm* — Buchanan Ingersoll & Rooney PC

(57) ABSTRACT

A vehicle door opening/closing device includes: an inside handle mounted to a vehicle door and operated from a vehicle interior to perform a door opening/closing operation; an outside handle mounted to the door and operated from a vehicle exterior to perform the door opening/closing operation; a locking mechanism actuated to lock the door at a predetermined position; an open mechanism; a release mechanism; and a cancel mechanism. The open mechanism is actuated according to operation of the inside and outside handles to release the lock by the locking mechanism. The release mechanism includes an electric motor and a power-transmission member transmitting electric motor power to the open mechanism, and actuates the open mechanism to release the lock of the door. Further, the cancel mechanism is actuated by operating the inside and outside handles to interrupt transmission of the electric motor driving force to the open mechanism by the power-transmission member.

7 Claims, 21 Drawing Sheets

VEHICLE DOOR OPENING-CLOSING DEVICE

TECHNICAL FIELD

This disclosure relates to a vehicle door opening/closing device.

BACKGROUND ART

In general, a locking mechanism such as a latch-and-pawl mechanism is built in a door of a vehicle. A pawl restricts the rotation of a latch in a state in which the latch holds a striker of the door. As a result, the door is locked at a predetermined position, for example, a fully-closed position or a fully-opened position. There is known a vehicle door opening/closing device having a function of turning the pawl, which restricts the rotation of the latch, by an electric motor to release the lock of the vehicle door at the predetermined position. In the above-mentioned type of vehicle door opening/closing device, in the case where the electric motor fails when the locking mechanism for locking the door is in a release state in which the lock is released, the locking mechanism maintains the release state. Therefore, the door cannot be locked from then on. Thus, a vehicle door opening/closing device having a cancel function for cancelling the release state when the electric motor fails in the release state is desired.

Japanese Patent Application Laid-open No. 2010-31569 discloses a vehicle door opening/closing device having the cancel function. The vehicle door opening/closing device has a cancel-operation bar for interrupting power transmission between the electric motor and the locking mechanism when the electric motor fails in the release state. The cancel-operation bar can be operated by a tool inserted from an operation hole formed through the vehicle door. By the above-mentioned operation, the power transmission between the electric motor and the locking mechanism is interrupted. As a result, the release state is cancelled.

In many cases, however, a vehicle occupant does not know the presence or location of the above-mentioned cancel-operation bar or the operation hole for inserting the tool for operating the cancel-operation bar therein. Therefore, in case of emergency as described above, the occupant needs to call a repairperson or check a vehicle-operation manual. Therefore, the release state cannot be quickly cancelled. Moreover, even when the vehicle occupant knows the presence of the cancel-operation bar and the operation hole described above, the operation bar is required to be operated through the operation hole. Therefore, an operation for cancelling the release state is cumbersome.

Therefore, a vehicle door opening/closing device configured to avoid the above-mentioned disadvantages is desired.

SUMMARY

A vehicle door opening/closing device disclosed herein includes: an inside handle adapted to be mounted to a door of a vehicle and adapted to be operated from a vehicle interior when an opening/closing operation is to be performed for the door; an outside handle adapted to be mounted to the door and adapted to be operated from a vehicle exterior when the opening/closing operation is to be performed for the door; a locking mechanism adapted to be actuated to lock the door at a predetermined open/close position; an open mechanism; a release mechanism; and a cancel mechanism. The open mechanism is adapted to be actuated in accordance with an operation of the inside handle and an operation of the outside handle to release the lock of the door by the locking mechanism. The release mechanism includes an electric motor and a power-transmission member for transmitting power of the electric motor to the open mechanism, and is adapted to actuate the open mechanism by a driving force of the electric motor to release the lock of the door. Further, the cancel mechanism is to be actuated in accordance with the operation of the inside handle and the operation of the outside handle to interrupt transmission of the driving force of the electric motor to the open mechanism by the power-transmission member.

DETAILED DESCRIPTION

Figure 1:
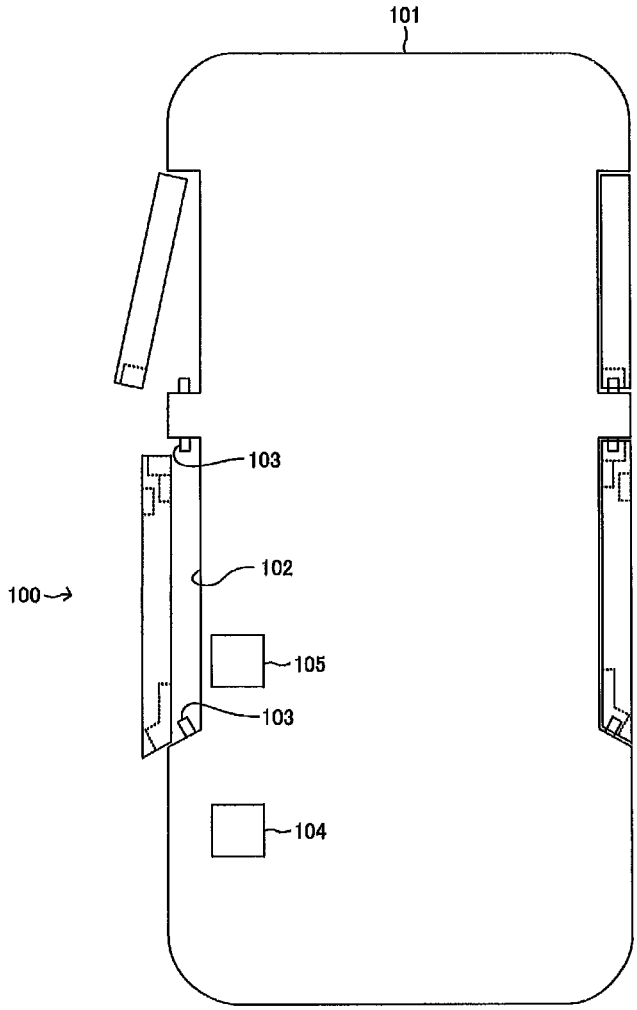
FIG. 1 A view illustrating a vehicle including sliding doors.

An embodiment of this disclosure is described below referring to the accompanying drawings. When an element is referred to as being "connected to" or "coupled to" another element, it can be directly connected or coupled to the other element or intervening elements may be present. FIG. 1 illustrates a vehicle including sliding doors. A sliding door 100 is mounted to a vehicle main body 101 to be openable/closable with respect to a doorway 102 so as to be capable of assuming a fully-closed state in which the doorway 102 of the vehicle main body 101 is fully closed and a fully-opened state in which the doorway 102 is fully opened. An outside handle for an opening/closing operation of the sliding door 100 is provided on an outdoor surface of the sliding door 100, whereas an inside handle for the opening/closing operation of the sliding door 100 is provided on an indoor surface of the sliding door 100.

Figure 2:
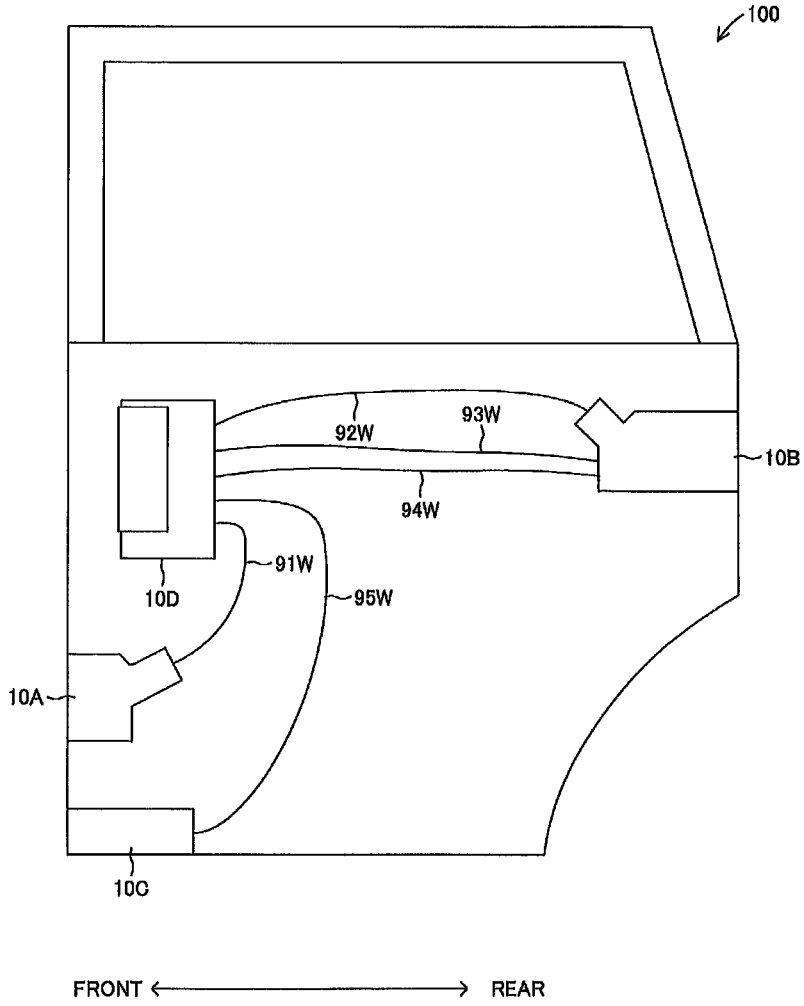
FIG. 2 A view illustrating the sliding door and a vehicle door opening/closing device mounted to the sliding door.

FIG. 2 is a view illustrating the sliding door 100 and a vehicle door opening/closing device mounted to the sliding door 100. As illustrated in FIG. 2, inside the sliding door 100, there are provided a front-side door lock device 10A and a rear-side door lock device 10B for locking the sliding door 100 at a fully-closed position, a full-open door lock device 10C for locking the sliding door 100 at a fully-opened position, and a remote-control device 10D connected to the door lock devices through connection members such as cables to operate the actuation of the door lock devices through the connection members. The front-side door lock device 10A is provided on a front-end side of the sliding door 100, whereas the rear-side door lock device 10B is provided on a rear-end side of the sliding door 100. The full-open door lock device 10C is provided in a lower area of the front end of the sliding door 100. A plurality of strikers 103 are provided on an inner surface of a door frame of the vehicle main body 101 so as to correspond to the positions at which the door lock devices are provided (see FIG. 1). A door control device 104 is mounted at a desired position in the vehicle main body 101. The door control device 104 controls an operation relating to the actuation of the sliding door 100 to be opened and closed. A power sliding-door unit 105 is also mounted to the vehicle main body 101. The power sliding-door unit 105 includes a driving component for automatically opening and closing the sliding door 100 and actuates the sliding door 100 to be opened and closed based on a command from the door control device 104. The front-side door lock device 10A, the rear-side door lock device 10B, the full-open door lock device 10C, the remote-control device 10D, the door control device 104, and the power sliding-door unit 105 constitute the vehicle door opening/closing device according to this embodiment.

Figure 6A:
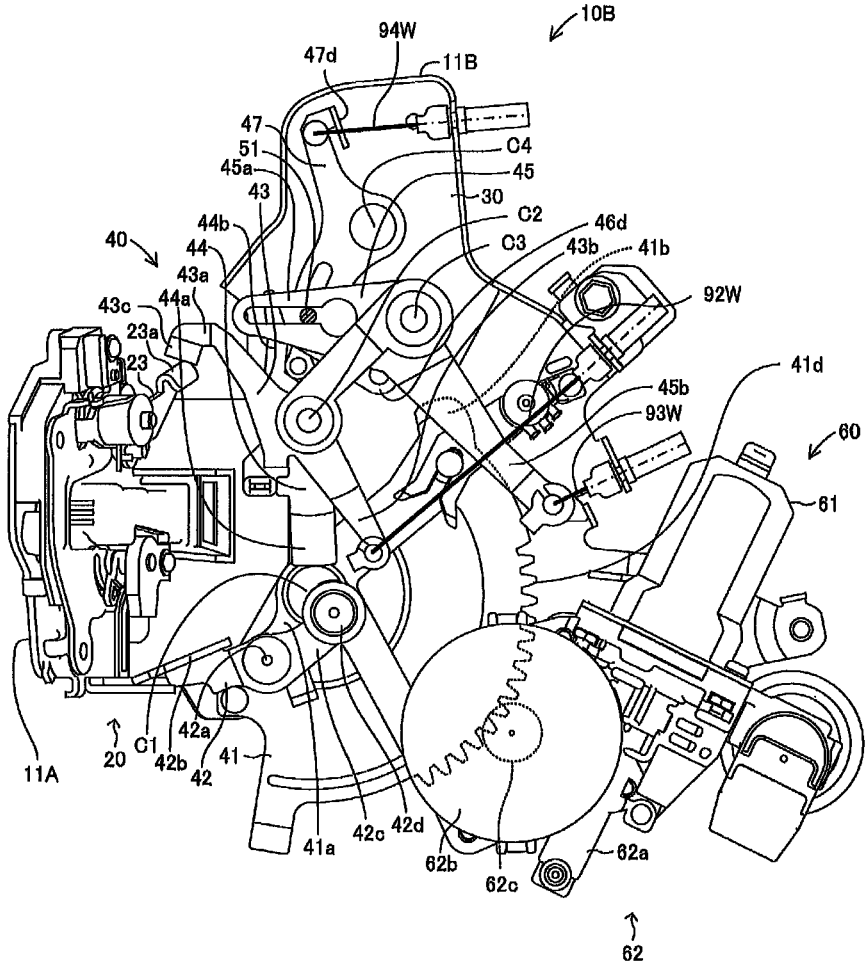
FIG. 6A A front view of the rear-side door lock device.
Figure 6B:
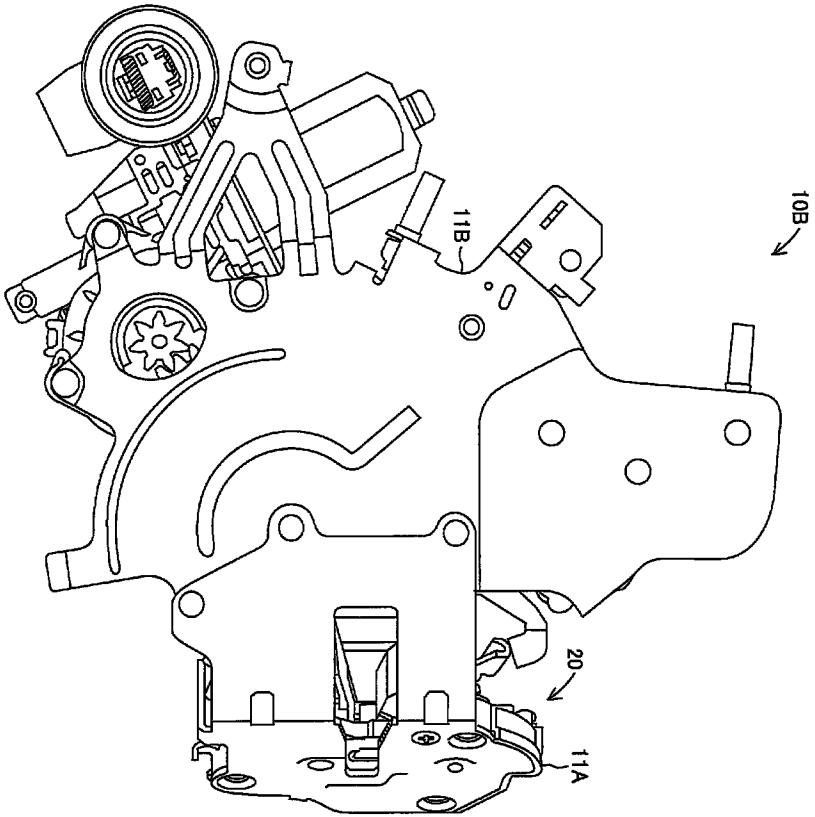
FIG. 6B A back view of the rear-side door lock device.

FIG. 6A is a front view illustrating a schematic configuration of the rear-side door lock device 10B, whereas FIG. 6B is a back view of the rear-side door lock device 10B. Note that, a configuration of the front-side door lock device 10A is similar to that of the rear-side door lock device 10B, and therefore a specific description thereof is herein omitted. As can be seen from FIGS. 6A and 6B, the rear-side door lock device 10B includes a first base board 11A, a second base board 11B, a latch-and-pawl mechanism 20 as a locking mechanism, a lever mechanism 40, and a driving section 60. The first base board 11A is coupled to the second base board 11B through a fastening member such as a bolt. The first base board 11A and the second base board 11B respectively have planes which intersect each other. The latch-and-pawl mechanism 20 is mounted to the first base board 11A. The lever mechanism 40 and the driving section 60 are mounted to the second base board 11B.

Figure 3:
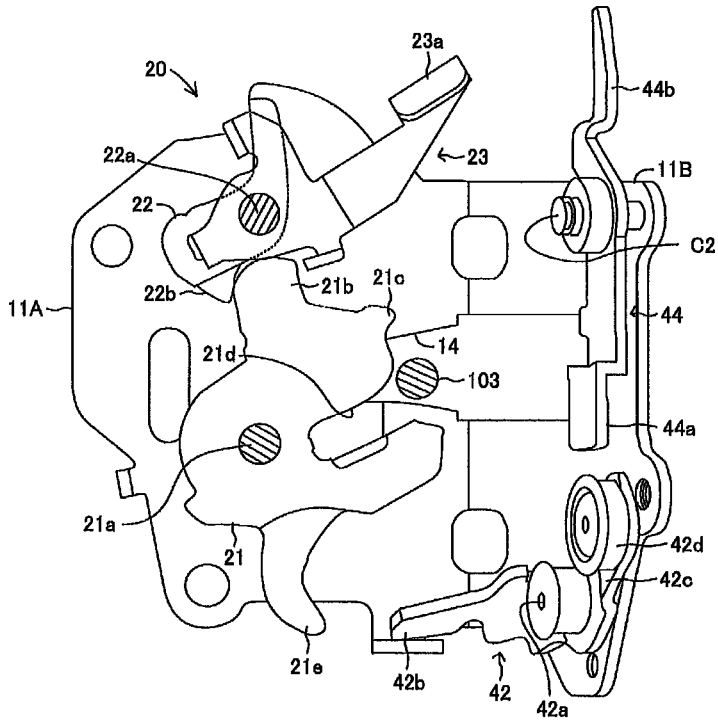
FIG. 3 A view mainly illustrating a latch-and-pawl mechanism of a rear-side door lock device.

FIG. 3 is a view mainly illustrating a schematic configuration of the latch-and-pawl mechanism 20 mounted to the first base board 11A. As illustrated in FIG. 3, the latch-and-pawl mechanism 20 includes a latch 21, a pawl 22, a pawl-driving lever 23, and a striker-receiving groove 14 formed on the first base board 11A. When the sliding door 100 is closed, the striker 103 enters the striker-receiving groove 14 from an open end of the striker-receiving groove 14.

The pawl 22 is turnably supported on the first base board 11A at a position above the striker-receiving groove 14 in FIG. 3. The pawl 22 includes a latch-locking piece 22*b* extending from a turning shaft 22*a* to the left in FIG. 3. A torsion-coil spring (not shown) is provided between the pawl 22 and the first base board 11A. By the torsion-coil spring, the pawl 22 is biased in a counterclockwise direction (restricting direction) in FIG. 3.

The pawl-driving lever 23 is configured so as to turn integrally with the pawl 22 about the turning shaft 22*a*. When the pawl-driving lever 23 turns in a clockwise direction in FIG. 3, the pawl 22 turns in association in the clockwise direction (cancelling direction) in FIG. 3 against a biasing force of the torsion-coil spring.

The latch 21 is turnably supported on the first base board 11A at a position below the striker-receiving groove 14. The latch 21 includes a half-latch claw 21*b* and a full-latch claw 21*c*, which project from a turning shaft 21*a* in a radially outward direction. In a lower portion of the full-latch claw 21*c* in FIG. 3, a groove 21*d* extending radially outward from the turning shaft 21*a* is formed. The striker 103 is received and housed in the groove 21*d*. A torsion-coil spring (not shown) is provided between the latch 21 and the first base board 11A. By the torsion-coil spring, the latch 21 is biased in the clockwise direction (cancelling direction) in FIG. 3. In a state in which the sliding door 100 is open, a stopper (not shown) formed on the latch 21 abuts against the first base board 11A so that the latch 21 is positioned at a predetermined position (cancelling position) as illustrated in FIG. 3.

When the sliding door 100 is slid in a closing direction in a state in which the sliding door 100 is open, the striker 103 enters the striker-receiving groove 14. The striker 103 further enters the groove 21*d* formed on the latch 21. The striker 103 abuts against side walls of the groove 21*d*, and hence the latch 21 is pressed by the striker 103 to turn in the counterclockwise direction (restricting direction) in FIG. 3. As a result, the latch 21 comes into meshing engagement with the striker 103.

Figure 4:
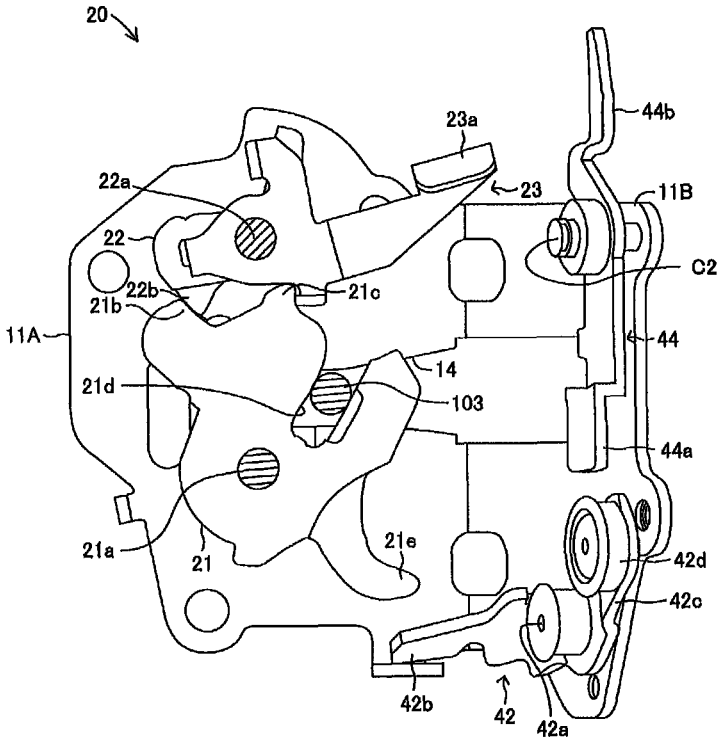
FIG. 4 A view illustrating a schematic configuration of the latch-and-pawl mechanism when a position of rotation of the latch is a half-latch position.
Figure 5:
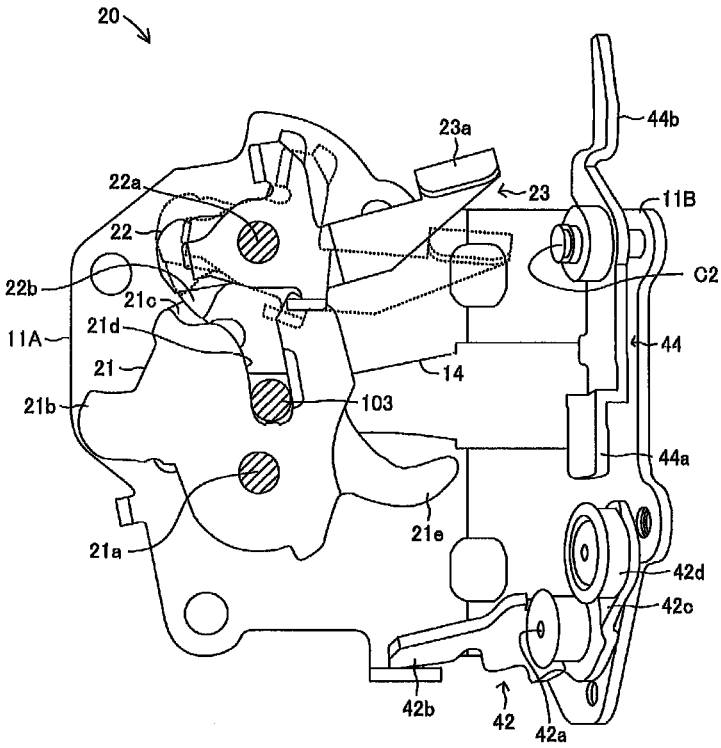
FIG. 5 A view illustrating the schematic configuration of the latch-and-pawl mechanism when the position of rotation of the latch is a full-latch position.

When the latch 21 is pressed by the striker 103, a position of the rotation of the latch 21 moves from the cancelling position illustrated in FIG. 3 through a position of rotation (half-latch position) illustrated in FIG. 4 to a position of rotation (full-latch position) illustrated in FIG. 5. At the full-latch position illustrated in FIG. 5, the full-latch claw 21*c* of the latch 21 comes into engagement with the latch-locking piece 22*b* of the pawl 22 so as to restrict the turning of the latch 21 in the cancelling direction and to maintain a state in which the latch 21 holds the striker 103. Therefore, the sliding door 100 is locked at the fully-closed position, while the fully-closed state is maintained. When the position of rotation of the latch 21 is the half-latch position illustrated in FIG. 4, the half-latch claw 21*b* of the latch 21 comes into engagement with the latch-locking piece 22*b* of the pawl 22. Also in this state, the state in which the latch 21 holds the striker 103 is maintained. However, the sliding door 100 is locked at a position in the vicinity of the fully-closed position. An open/close state of the sliding door 100 is a so-called half-shut state.

A piece 23*a* to be depressed is formed on the pawl-driving lever 23. The piece 23*a* to be depressed is provided at a position so as to be depressed by a depressing piece 43*c* of an open lever 43 described later. When the latch 21 holds the striker 103, the piece 23*a* to be depressed is depressed by the open lever 43. As a result, the pawl-driving lever 23 is operated to turn in the clockwise direction in FIG. 5. Along with the turning, the pawl 22 also turns in the clockwise direction (cancelling direction). Then, the pawl 22 rotates to a position of rotation (cancelling position) indicated by a dotted line illustrated in FIG. 5. At the position of rotation indicated by the dotted line, the pawl 22 does not come into engagement with the latch 21. Therefore, the restriction on the rotation of the latch 21 by the pawl 22 is cancelled. As a result, the turning of the latch 21 in the cancelling direction is allowed. In this state, the sliding door 100 can be opened. Specifically, the lock of the sliding door 100 by the latch-and-pawl mechanism is released.

Moreover, as illustrated in FIG. 3, a leg portion 21*e* is formed on the latch 21. The leg portion 21*e* extends downward in FIG. 3 from the turning shaft 21*a* of the latch 21. When the latch 21 is at the half-latch position, the leg portion 21*e* abuts against a seesaw-type lever 42 described later.

The full-open door lock device 10C also includes a latch-and-pawl mechanism similar to the latch-and-pawl mechanism described above. When the sliding door 100 is in a fully-opened state, a pawl restricts the rotation of a latch in the cancelling direction so that the full-open door lock device 10C maintains a state in which the latch retains the striker. In this manner, the sliding door 100 is locked at the fully-opened position, while the fully-opened state of the sliding door 100 is maintained. Then, by performing a closing operation for the inside handle or the outside handle when the sliding door 100 is in the fully-opened state, the restriction of the latch by the pawl is cancelled. As a result, the sliding door 100 can be closed. The full-open door lock device 10C generally has two positions for the latch, that is, the cancelling position and the full-latch position.

As illustrated in FIG. 6A, the lever mechanism 40 includes an active lever 41, the seesaw-type lever 42, the open lever 43, a positioning lever 44, a release lever 45, a relay lever 46, and a cancel lever 47. A direction of a rotary shaft of each of the levers is the same. Each of the levers is supported by the second base board 11B. The direction of the rotary shaft of each of the levers is perpendicular to a direction of the rotary shafts of the latch 21, the pawl 22, and the pawl-driving lever 23, which are supported by the first base board 11A.

The active lever 41 has an approximately fan-like shape as illustrated in FIG. 6A and is turnably supported about a center of an arc (shaft center) C1 on the second base board 11B. A gear 41*d* is formed on an outer circumference of a circular arc edge of the active lever 41. A support projecting piece 41*a* extending from the shaft center C1 to the lower left in FIG. 6A and an abutment piece 41*b* extending from the shaft center C1 to the upper right in FIG. 6A are formed on the active lever 41. The seesaw-type lever 42 is turnably supported on the support projecting piece 41*a*.

The abutment piece 41*b* is provided so as to project upward in FIG. 6A from a counterclockwise end of the circular arc edge of the active lever 41. The abutment piece 41*b* is configured so as to come into engagement with a projecting portion 46*d* of the relay lever 46 described below when the active lever 41 turns about the shaft center C1 in FIG. 6A in the counterclockwise direction.

The seesaw-type lever 42 includes a first arm portion 42*b* extending from a turning shaft 42*a* in one direction and a second arm portion 42*c* extending in a direction opposite to the direction in which the first arm portion 42*b* extends, and is formed into a seesaw-like shape with the turning shaft 42*a* interposed therebetween. The first arm portion 42*b* is provided at a position so that a distal end thereof can abut against the leg portion 21*e* of the latch 21. On the other hand, an abutment roller 42*d* is mounted to a distal end of the second arm portion 42*c*. The seesaw-type lever 42 is biased by the torsion-coil spring so that the distal end portion of the first arm portion 42*b* moves away from the leg portion 21*e* of the latch 21.

The positioning lever 44 is supported coaxially with the open lever 43 so as to be turnable about a shaft center C2 on the second base board 11B. The positioning lever 44 includes a first abutment piece 44*a* extending downward in FIG. 6A from the shaft center C2 and a second abutment piece 44*b* extending upward in FIG. 6 from the shaft center C2. When the active lever 41 turns about the shaft center C1 in FIG. 6A in the clockwise direction, the abutment roller 42*d* abuts against a lower end of the first abutment piece 44*a* of the positioning lever 44. As a result, the abutment roller 42*d* is positioned. On the other hand, when the positioning lever 44 moves to a position at which the abutment roller 42*d* is not positioned, the positioning and the support for the seesaw-type lever 42 by the positioning lever 44 are cancelled. As a result, the seesaw-type lever 42 can rotate relative to the active lever 41.

As described above, the open lever 43 is supported coaxially with the positioning lever 44 so as to be turnable about the shaft center C2 on the second base board 11B. The open lever 43 includes a pawl-driving arm portion 43*a* extending from the shaft center C2 in one direction and a cable-mounting piece 43*b* extending from the shaft center C2 in a direction opposite to the direction in which the pawl-driving arm portion 43*a* extends. The depressing piece 43*c* is provided to a distal end of the pawl-driving arm portion 43*a*. The depressing piece 43*c* depresses the piece 23*a* to be depressed of the pawl-driving lever 23 as described above. On the other hand, one end of an open cable 92W is connected to a distal end of the cable-mounting piece 43*b*. A torsion spring (not shown) is mounted to the open lever 43 which is biased in a direction in which the open cable 92W is pulled, that is, in the clockwise direction in FIG. 6 by the torsion spring.

Figure 7:
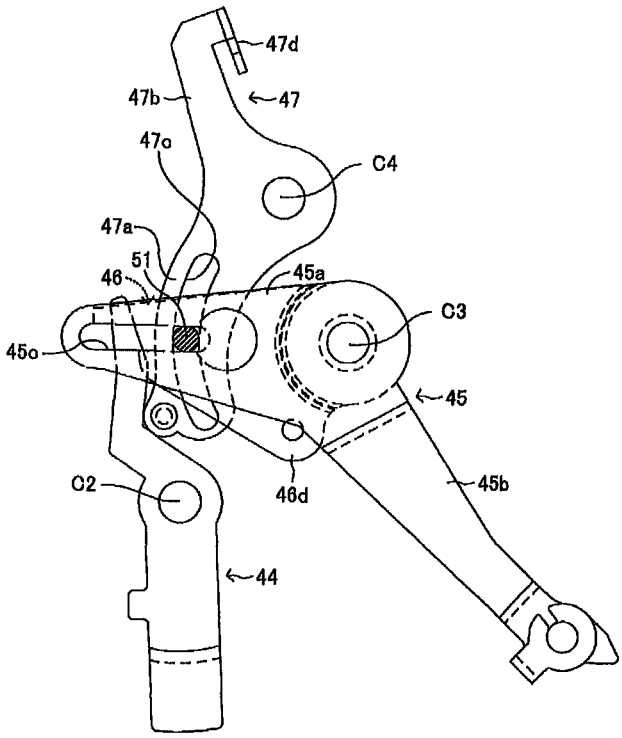
FIG. 7 A view illustrating a relationship of arrangement among a positioning lever, a release lever, a relay lever, and a cancel lever.
Figure 8:
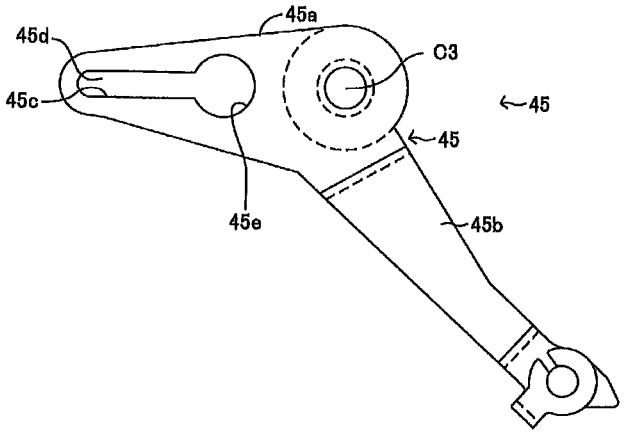
FIG. 8 A front view of the release lever.
Figure 9:
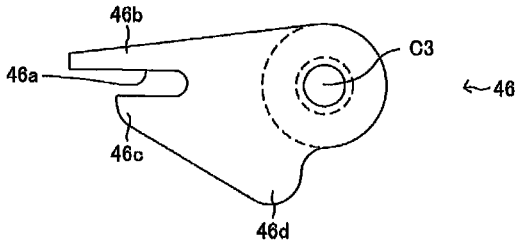
FIG. 9 A front view of the relay lever.
Figure 10:
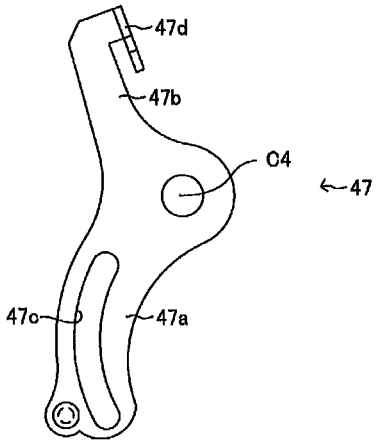
FIG. 10 A front view of the cancel lever.

FIG. 7 is a view illustrating a relationship of arrangement among the positioning lever 44, the release lever 45, the relay lever 46, and the cancel lever 47. FIG. 8 is a front view of the release lever 45. FIG. 9 is a front view of the relay lever 46. FIG. 10 is a front view of the cancel lever 47.

As illustrated in FIG. 6A, the release lever 45 is turnably supported on the second base board 11B at a position (shaft center C3) which is separated away from the shaft center C2 of the open lever 43 so as to be located on the obliquely upper right thereof. As illustrated in FIGS. 7 and 8, the release lever 45 includes a coupling piece 45*a* extending from the shaft center C3 to the left, which is formed so as to be tapered toward a distal end thereof, and a cable-mounting piece 45*b* extending obliquely downward to the right from the shaft center C3. A hole portion 45*c* extending in a horizontal direction is formed through the coupling piece 45*a*. The hole portion 45*c* includes an elongated hole portion extending in the horizontal direction and a round hole portion having a diameter larger than a shorter diameter (width) of the elongated hole portion, which is formed at a right end of the elongated hole portion. A coupling pin 51 is inserted into the hole portion 45*c*. The release lever 45 is biased in the counterclockwise direction in FIG. 7 by a torsion spring (not shown). The release lever 45 abuts against a stopper (not shown) to be positioned at a position (original position) illustrated in FIG. 7. In FIG. 7, the coupling pin 51 is inserted into the elongated hole portion of the hole portion 45*c*. As illustrated in FIG. 6A, one end of a release cable 93W is connected to a distal end of the cable-mounting piece 45*b*.

The relay lever 46 is supported coaxially with the release lever 45 so as to be turnable about the shaft center C3 on the second base board 11B. The relay lever 46 is provided so as to be overlapped with the coupling piece 45*a* of the release lever 45 and is formed so as to be tapered toward the distal end from the shaft center C3, similarly to the coupling piece 45*a*. As is clearly illustrated in FIG. 9, a cutout 46*a* which is open to the distal end side is formed in a distal end portion of the relay lever 46. The cutout 46*a* is formed so as to extend in the horizontal direction in FIG. 9. The cutout 46*a* is overlapped with the elongated hole portion of the hole portion 45*c* of the release lever 45 when the relay lever 46 and the release lever 45 are overlapped with each other. The above-mentioned coupling pin 51 can be inserted also into the cutout 46*a* of the relay lever 46. An upper portion 46*b* and a lower portion 46*c*, each extending from the shaft center C3 to the left in FIG. 9, are formed in parallel to each other so as to be separated away from each other in the vertical direction, with the cutout 46*a* as a boundary. A length of the upper portion 46*b* is larger than a length of the lower portion 46*c*. The projecting portion 46*d* projecting downward is formed on the relay lever 46. The projecting portion 46*d* is formed at a position at which the abutment piece 41*b* of the active lever 41 comes into engagement therewith when the active lever 41 turns about the shaft center C1 (see FIG. 6A) in the counterclockwise direction in FIG. 6A. The relay lever 46 is biased in the counterclockwise direction in FIG. 7 by a torsion spring (not shown) and abuts against a stopper (not shown) to be positioned at a position (original position) illustrated in FIG. 7. When the positions of rotation of the release lever 45 and the relay lever 46 are both the original positions, the cutout 46*a* of the relay lever 46 is overlapped with the elongated hole portion of the hole portion 45*c* of the release lever 45.

The cancel lever 47 is turnably supported on the second base board 11B at a position (shaft center C4) above the release lever 45, as illustrated in FIG. 6A. As illustrated in FIGS. 7 and 10, the cancel lever 47 includes a first arm portion 47*a* extending in an arc-like fashion from the shaft center C4 in a direction approaching the release lever 45 and a second arm portion 47*b* extending from the shaft center C4 in a direction opposite to the direction in which the first arm portion 47*a* extends. An arc-like elongated hole 47*c* having the shaft center C3 as a center is provided to the first arm portion 47*a*. The first arm portion 47*a* is arranged so as to be overlapped with the coupling piece 45*a* of the release lever 45 and the relay lever 46 as viewed from the direction illustrated in FIG. 7. The coupling pin 51 is also inserted through the elongated hole 47*c* of the cancel lever 47. Specifically, the levers are arranged so that the coupling pin 51 can be simultaneously inserted through the elongated hole 47*c* of the cancel lever 47, the hole portion 45*c* of the release lever 45, and the cutout 46*a* of the relay lever 46. The cancel lever 47 is biased in the counterclockwise direction in FIG. 7 by a torsion spring (not shown) and abuts against a stopper (not shown) to be positioned at a position (original position) illustrated in FIG. 7. A cable-mounting piece 47*d* is mounted to the second arm portion 47*b*. The cable-mounting piece 47*d* is connected to one end of a cancel cable 94W.

The driving section 60 is driven based on a driving command signal from the door control device 104. The driving section 60 executes a closing operation for performing driving so that the sliding door 100 is automatically locked at a fully-closed position when, for example, a locked state of the sliding door 100 is a half-shut state, and a releasing operation for performing driving so as to automatically cancel the restriction on the latch by the pawl.

As illustrated in FIG. 6A, the driving section 60 includes an electric motor 61 and a speed-reduction mechanism 62. The electric motor 61 is fixed at a desired position on the second base board 11B. The speed-reduction mechanism 62 is a worm-type speed reducer including a worm gear 62*a*, a wheel gear 62*b*, and a pinion gear 62*c*. The worm gear 62*a* is provided coaxially with an output shaft of the electric motor 61 so as to rotate integrally with the output shaft. The wheel gear 62 includes a rotary shaft which is perpendicular to a rotary shaft of the worm gear 62*a* and is brought into meshing engagement with the worm gear 62*a* so as to decelerate the rotation of the worm gear 62*a*. The pinion gear 62*c* has a diameter smaller than that of the wheel gear 62*b* and is mounted to the wheel gear 62*b* so as to rotate coaxially with the wheel gear 62*b*. The speed-reduction mechanism 62 having the configuration described above is fixed at a desired position on the second base board 11B so that the pinion gear 62*c* comes into meshing engagement with the gear 41*d* formed on the outer circumferential edge of the active lever 41.

Figure 11:
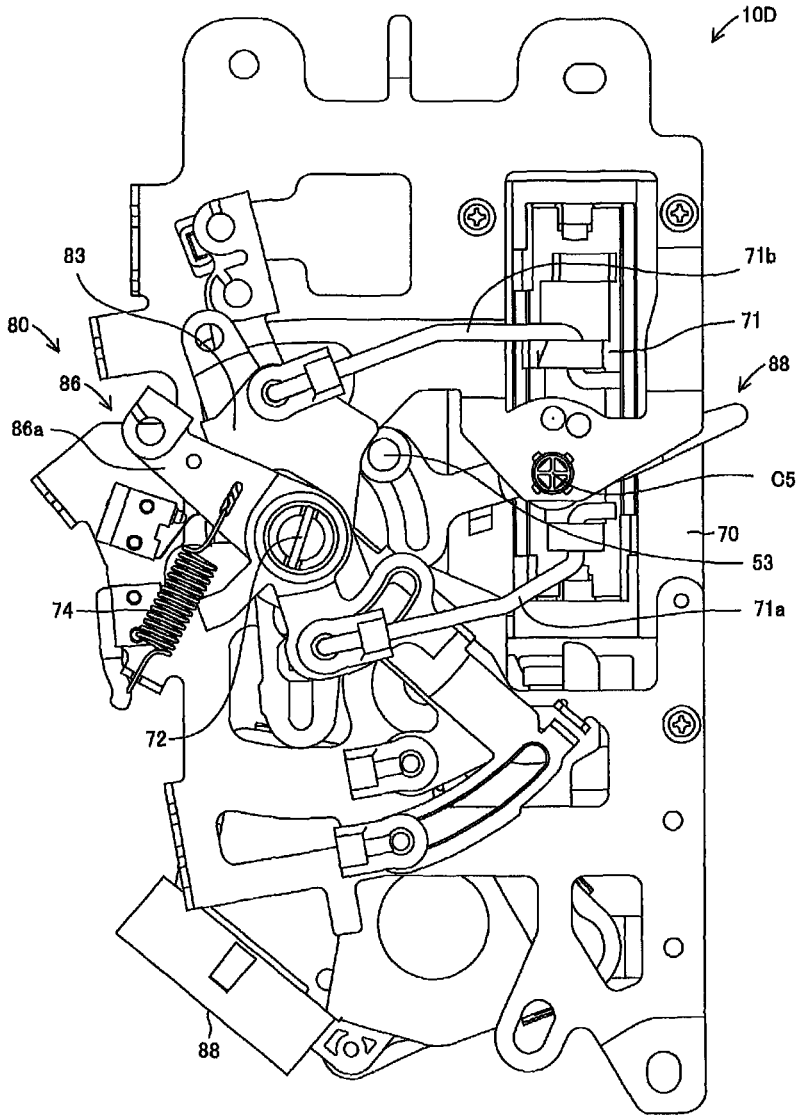
FIG. 11 A view illustrating a remote-control device.

FIG. 11 is a view illustrating the remote-control device 10D. As illustrated in FIG. 11, the remote-control device 10D includes a plate-like base board 70 and an operation mechanism 80. The operation mechanism 80 is mounted to the base board 70 of one surface side thereof. On the other surface side of the base board 70, an inside handle 71 is provided. Therefore, by mounting the remote-control device 10D to the sliding door 100, the inside handle 71 is mounted to the sliding door 100.

The inside handle 71 has a vertically elongated shape extending in the vertical direction in FIG. 11 and is exposed on an indoor surface of the sliding door 100. When the opening/closing operation for the sliding door 100 is performed, the inside handle 71 is manually operated by an occupant in the vehicle interior. The inside handle 71 is configured so as to be tiltable in a direction in which the sliding door 100 slides. Specifically, the inside handle 71 is biased to be located in an original position illustrated in FIG. 11 by the torsion-coil spring and is configured so as to enable a closing operation of tilting the inside handle from the original position toward a direction in which the sliding door 100 is closed, and an opening operation of tilting the inside handle from the original position toward a direction in which the sliding door 100 is opened.

Figure 12:
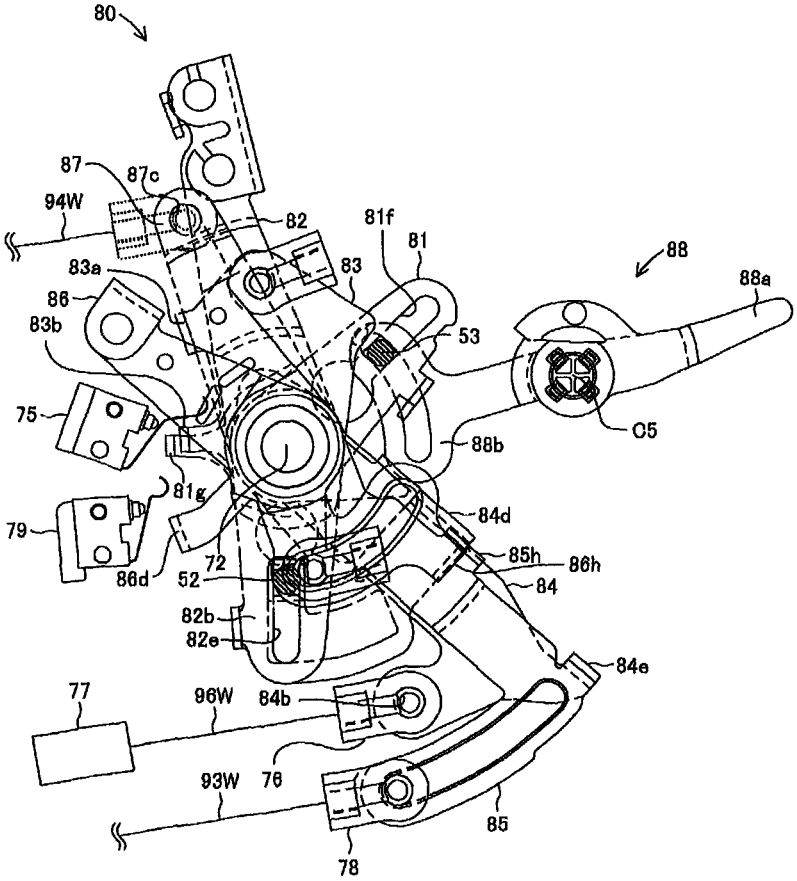
FIG. 12 A view illustrating a main configuration inside the remote-control device including an operation mechanism.

FIG. 12 is a view illustrating a main configuration inside the remote-control device 10D including the operating mechanism 80. As illustrated in FIG. 12, the operation mechanism 80 includes a locking lever 81, a remote-control-device side open lever 82, an inside-handle lever 83, an outside-handle lever 84, a remote-control-device side release lever 85, a full-open lock lever 86, and a remote-control-device side cancel lever 87. The above-mentioned levers are supported rotatably by a support shaft 72 standing upright on the base board 70 in a state in which the levers are overlapped with each other.

Figure 13:
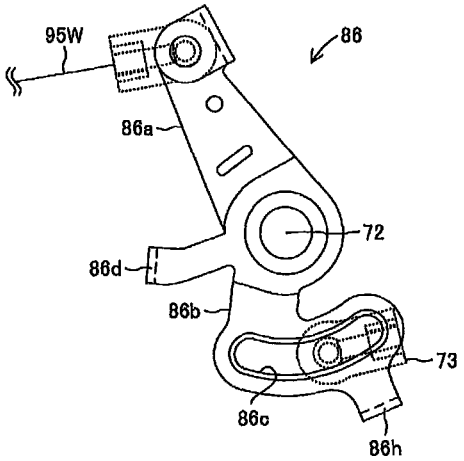
FIG. 13 A front view of a full-open lock lever.

FIG. 13 is a front view of the full-open lock lever 86. As illustrated in FIG. 13, the full-open lock lever 86 includes a first lever projecting piece 86*a* extending upward from the support shaft 72 and a second lever projecting piece 86*b* extending downward therefrom. A distal end portion of the first lever projecting piece 86*a* is connected to the pawl (pawl-driving lever) provided to the full-open door lock device 10C through an open cable 95W (see FIG. 2). An arc-like elongated hole 86*c* having the support shaft 72 as a center is formed through the second lever projecting piece 86*b*. A slide bush 73 is supported slidably in the arc-like elongated hole 86*c*. A rod 71*a* extending from the inside handle 71 is fixed to the slide bush 73 (see FIG. 11). When the closing operation for the inside handle 71 is performed while the sliding door 100 is in the fully-opened state, the full-open lock lever 86 is pushed by the rod 71*a* to turn about the support shaft 72 in the clockwise direction in FIGS. 11 to 13. Then, the open cable 95W connected to the first lever projecting piece 86*a* is pulled toward the remote-control device 10D so that the restriction on the turning of the latch by the pawl provided to the full-open door lock device 100 is cancelled. As illustrated in FIG. 11, a coil spring 74 is provided between the first lever projecting piece 86*a* of the full-open lock lever 86 and the base board 70. By the coil spring 74, the full-open lock lever 86 is biased in the counterclockwise direction in FIGS. 11 to 13. Then, the slide bush 73 comes into engagement with the full-open lock lever 86 at an end of the arc-like elongated hole 86*c*. As a result, the full-open lock lever 86 is positioned at a position (original position) illustrated in FIG. 11.

A switch-depressing projecting piece 86*d* is formed on the full-open lock lever 86. The switch-depressing projecting piece 86*d* is extended from the support shaft 72 to the left of FIGS. 11 to 13. When the full-open lock lever 86 turns about the support shaft 72 in the clockwise direction, the switch-depressing projecting piece 86*d* depresses a switch 79 fixed to the base board 70. An ON/OFF state of the switch 79 is input to the door control device 104. Further, an engagement piece 86*h* is formed on the full-open lock lever 86. The engagement piece 86*h* is formed so as to project from a lower area of the arc-like elongated hole 86*c* outward in a radial direction of the turning of the full-open lock lever 86 and is configured so as to be engageable with an engagement piece 85*h* of the remote-control-device side release lever 85 described below.

Figure 14:
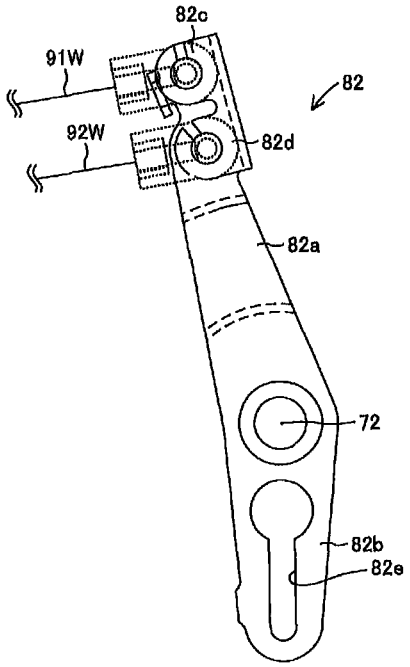
FIG. 14 A front view of a remote-control-device side open lever.

FIG. 14 is a front view of the remote-control-device side open lever 82. As illustrated in FIG. 14, the remote-control-device side open lever 82 includes a first lever projecting piece 82*a* and a second lever projecting piece 82*b*, which extend from the support shaft 72 in directions opposite to each other. As described below, a torsion-coil spring is mounted between the locking lever 81 and the base board 70 (support shaft 72). The locking lever 81 is biased in the counterclockwise direction in FIG. 11 by a biasing force of the torsion-coil spring. The remote-control-device side open lever 82 is coupled to the locking lever 81 by a movable pin 52 described below. Therefore, the remote-control-device side open lever 82 is biased in the counterclockwise direction by the biasing force of the torsion-coil spring. Then, the remote-control-device side open lever 82 comes into engagement with the base board 70 at a position of rotation illustrated in FIG. 11 so as to be positioned at a position (original position) illustrated in FIG. 11.

Moreover, as illustrated in FIG. 14, at a distal end of the first lever projecting piece 82*a*, a front-side open-cable mounting portion 82*c* and a rear-side open-cable mounting portion 82*d* are formed. An open cable 91W having one end connected to the open lever provided to the front-side door lock device 10A is connected to the front-side open-cable mounting portion 82*c*. Therefore, the first lever projecting piece 82*a* of the remote-control-device side open lever 82 is connected to the open lever provided to the front-side door lock device 10A through the open cable 91W. On the other hand, an end of the open cable 92W is connected to the rear-side open-cable mounting potion 82*d*. As described above, one end of the open cable 92W is connected to the open lever 43 of the rear-side door lock device 10B. Thus, the first lever projecting piece 82*a* of the remote-control-device side open lever 82 is connected to the open lever 43 of the rear-side door lock device 10B through the open cable 92W. The open lever 43, the open cable 92W, and the remote-control-device side open lever 82 constitute an open mechanism.

A linear elongated hole 82*e* extending in a radial direction of the turning of the remote-control-device side open lever 82 is formed through the second lever projecting piece 82*b* of the remote-control-device side open lever 82. As illustrated in FIG. 12, the movable pin 52 is inserted through the linear elongated hole 82*e*. The remote-control-device side open lever 82 is biased in the counterclockwise direction in FIGS. 11 and 12 by a spring and abuts against a stopper (not shown) to be positioned at a position (original position) illustrated in FIGS. 11 and 12.

Figure 15:
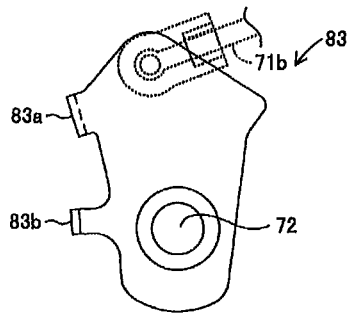
FIG. 15 A front view of an inside handle lever.

FIG. 15 is a front view of the inside handle lever 83. As illustrated in FIG. 15, the inside handle lever 83 extends upward from the support shaft 72. A locking piece 83*a* is formed in an upper portion of a left side surface thereof. The locking piece 83*a* can be engaged with a left end of the remote-control side cancel lever 87 in FIG. 12, which is described below. Moreover, the inside handle lever 83 is connected to the inside handle 71 by a rod 71*b* as illustrated in FIG. 11. When the opening operation for the inside handle 71 is performed, the rod 71*b* pulls the inside handle 71. Then, the inside handle lever 83 turns about the support shaft 72 in the clockwise direction. When the inside handle lever 83 turns in the clockwise direction, the remote-control-device side cancel lever 87 engaged with the locking piece 83*a* also turns in the clockwise direction in FIG. 12 in association with the turning of the inside handle lever 83.

A switch-depressing projecting piece 83*b* is integrally formed with the inside handle lever 83. The switch-depressing projecting piece 83*b* is formed so as to project toward a switch 75 fixed to the base board 70 as illustrated in FIG. 12. When the inside handle lever 83 turns in the clockwise direction, the switch-depressing projecting piece 83*b* depresses the switch 75. An ON/OFF state of the switch 75 is input to the door control device 104.

Figure 16:
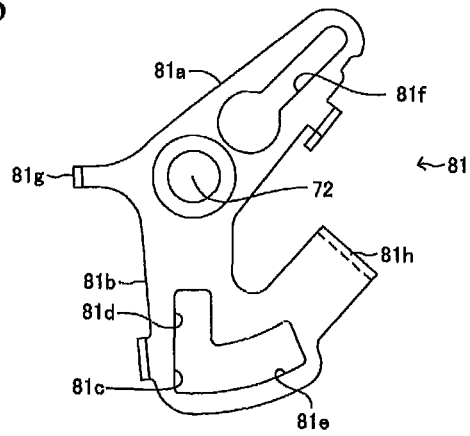
FIG. 16 A front view of a locking lever.

FIG. 16 is a front view of the locking lever 81. As illustrated in FIG. 16, the locking lever 81 includes a first lever projecting piece 81*a* extending obliquely upward to the right from the support shaft 72 and a second lever projecting piece 81*b* extending downward therefrom. A torsion-coil spring is wound around the first lever projecting piece 81*a* and the support shaft 72. The locking lever 81 is biased in the counterclockwise direction in FIGS. 11 and 12 by the torsion-coil spring and comes into engagement with a stopper (not shown) to be positioned at a predetermined position (original position).

The second lever projecting piece 81*b* has a hook-like shape having a linear portion extending downward from the support shaft 72 along a radial direction of the turning and an arc-like portion extending in the counterclockwise direction in an arc-like shape from a distal end of the linear portion. A hook-like elongated hole 81*c* conforming to the hook-like shape is formed through the second lever projecting piece 81*b*. The hook-like elongated hole 81*c* includes a linear portion 81*d* linearly extending in a radial direction of the turning of the locking lever 81 and an arc-like portion 81*e* extending along the counterclockwise direction in an arc-like shape from an end of the linear portion 81*d*, which is on the side farther from the support shaft 72. When the positions of rotation of the remote-control-device side open lever 82 and the locking lever 81 are both the original positions, the linear elongated hole 82*e* of the remote-control-device side open lever 82 and the linear portion 81*d* of the hook-like elongated hole 81*c* of the locking lever 81 are overlapped with each other. At this time, the movable pin 52 passes through the linear elongated hole 82*e* of the remote-control-device side open lever 82 and the linear portion 81*d* of the hook-like elongated hole 81*c* of the locking lever 81 so as to be movable in a reciprocating manner inside the above-mentioned holes. Further, when the locking lever 81 turns, the remote-control-device side open lever 82 turns through the intermediation of the movable pin 52.

An elongated hole 81*f* for child safety lock, extending along a direction in which the first lever projecting piece 81*a* extends, is formed through the first lever projecting piece 81*a* of the locking lever 81. A child safety lock pin 53 is supported in the elongated hole 81*f* for child safety lock as illustrated in FIG. 12. The child safety lock pin 53 passes through the elongated hole 81*f* for child safety lock and is movable in a reciprocating manner inside the elongated hole 81*f* for child safety lock.

For externally operating the child safety lock pin 53, a child-safety-lock operating section 88 is provided to the remote-control device 10D. The child-safety-lock operating section 88 is turnably supported on the base board 70. An end portion 88*a* thereof, which is separated away from a center C5 of turning, is exposed on an end surface of the sliding door 100. An arc-like elongated hole having the support shaft 72 as a center is formed through another end portion of the child-safety-lock operating section 88, which is separated away from the center C5 of turning. The child safety lock pin 53 is inserted through the arc-like elongated hole. The child safety lock pin 53 moves inside the elongated hole 81*f* for child safety lock so as to reciprocate between a child-safety-lock position located away from the support shaft 72 and a child-safety-unlock position closer to the support shaft 72 by an operation of turning the child-safety-lock operating section 88. In FIG. 12, the position of the child safety lock pin 53 is the child-safety-unlock position. When being located in the child-safety-unlock position, the child safety lock pin 53 is located in a region of turning of the inside handle lever 83. Therefore, when the inside handle lever 83 turns in the clockwise direction in FIG. 12, the locking lever 81 which supports the child safety lock pin 53 rotates integrally therewith through the intermediation of the child safety lock pin 53. Specifically, operation power, which is generated by the opening operation for the inside handle 71, is transmitted to the locking lever 81 through the inside handle lever 83 and the child safety lock pin 53. On the other hand, when being located in the child safety lock position, the child safety lock pin 53 retreats from the region of turning of the inside handle lever 83. As a result, the power transmission from the inside handle lever 83 to the locking lever 81 is interrupted. Specifically, the operation power generated by the opening operation for the inside handle 71 is not transmitted to the locking lever 81.

As illustrated in FIG. 16, a switch-depressing projecting piece 81*g* is formed integrally with the locking lever 81. The switch-depressing projecting piece 81*g* extends from the support shaft 72 to the left in FIG. 16 so as to project toward the switch 75. When the locking lever 81 turns in the clockwise direction, the switch-depressing projecting piece 81*g* depresses the switch 75. An engagement piece 81*h* is formed on the locking lever 81. The engagement piece 81*h* is formed at a distal end of the arc-like portion of the second lever projecting piece 81*b* of the locking lever 81.

Figure 17:
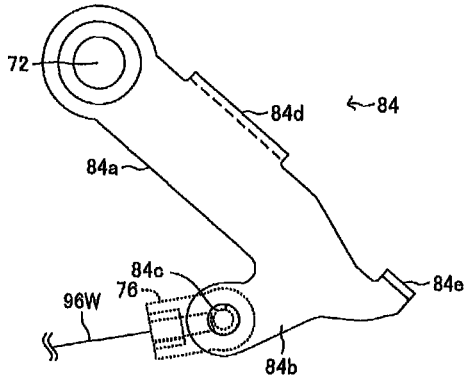
FIG. 17 A front view of an outside handle lever.

FIG. 17 is a front view of the outside handle lever 84. As illustrated in FIG. 17, the outside handle lever 84 includes a linear portion 84*a* extending obliquely downward to the right in FIG. 17 from the support shaft 72 and an engagement portion 84*b* extending from a distal end of the linear portion 84*a* to the left. A round hole 84*c* is formed through the engagement portion 84*b*. A slide bush 76 is engaged inside the round hole 84*c*. One end of an open cable 96W connected to the outside handle 77 is connected to the slide bush 76 as illustrated in FIG. 12. The outside handle 77 is mounted to the outdoor surface side of the sliding door 100 and is manually operated from the exterior of the vehicle when the opening/closing operation for the sliding door 100 is to be performed.

Moreover, as illustrated in FIG. 17, a first engagement portion 84*d* and a second engagement portion 84*e* are formed on one lateral edge of the linear portion 84*a* of the outside handle lever 84. When the outside handle lever 84 turns about the support shaft 72 in the clockwise direction, the first engagement portion 84*d* can come into engagement with the engagement piece 81*h* formed on the locking lever 81 and a first engagement portion 87*d* of the remote-control-device side cancel lever 87 described below. When the outside handle lever 84 turns about the support shaft 72 in the clockwise direction, the second engagement portion 84*e* can come into engagement with the remote-control-device side release lever 85 described below.

When the opening operation is performed for the outside handle 77, the open cable 96W is pulled toward the outside handle so that the outside handle lever 84 turns about the support shaft 72 in the clockwise direction in FIG. 12. At this time, the locking lever 81 and the remote-control-device side cancel lever 87, which are engaged with the first engagement portion 84*d*, and the remote-control-device side release lever 85 engaged with the second engagement portion 84*e* also turn about the support shaft 72 in the clockwise direction. In this case, if the movable pin 52 is inserted through both the linear elongated hole 82*e* of the remote-control-device side open lever 82 and the linear portion 81*d* of the hook-like elongated hole 81*c* of the locking lever 81, an operation force for opening the outside handle 77 is transmitted to the remote-control-device side open lever 82 through the locking lever 81 and the movable pin 52. As a result, the remote-control-device side open lever 82 turns in the clockwise direction.

Figure 18:
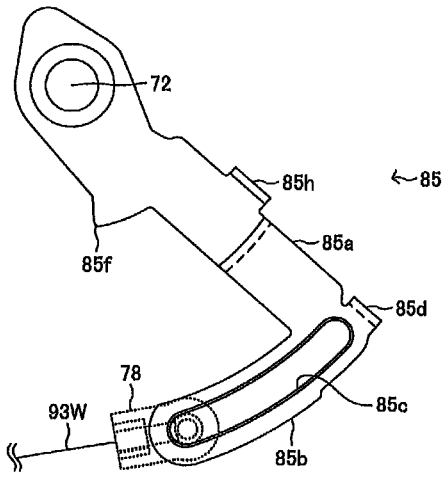
FIG. 18 A front view of a remote-control-device side release lever.

FIG. 18 is a front view of the remote-control-device side release lever 85. As illustrated in FIG. 18, the remote-control-device side release lever 85 includes a linear portion 85*a* extending obliquely downward to the right in FIG. 18 from the support shaft 72 and an arc-like portion 85*b* provided to extend in the clockwise direction in an arc-like shape from a distal end of the linear portion 85*a*. An arc-like elongated hole 85*c* having the support shaft 72 as a center is formed through the arc-like portion 85*b*. A slide bush 78 is slidably supported in the arc-like elongated hole 85*c*. Another end of the release cable 93W having one end connected to the cable-mounting piece 45*b* of the release lever 45 provided to the rear-side door lock device 10B is connected to the slide bush 78. Therefore, the remote-control-device side release lever 85 is connected to the release lever 45 of the rear-side door lock device 10B through the release cable 93W. The remote-control-device side release lever 85 is biased by a spring in the counterclockwise direction in FIG. 12 and then abuts against a stopper (not shown) to be positioned at a position (original position) illustrated in FIG. 12.

A first engagement portion 85*d* is formed on the remote-control-device side release lever 85. The first engagement portion 85*d* is provided to a distal end of one lateral edge of the linear portion 85*a* and can come into engagement with the second engagement portion 84*e* of the outside handle lever 84. A projecting portion 85*f* is also formed on the remote-control-device side release lever 85. The projecting portion 85*f* is formed so as to project from a central portion of another lateral edge of the linear portion 85*a* in the clockwise direction in FIG. 18. The projecting portion 85*f* comes into engagement with the movable pin 52 inserted through the linear elongated hole 82*e* of the remote-control-device side open lever 82 when the remote-control-device side release lever 85 turns about the support shaft 72 in the clockwise direction. The engagement piece 85*h* is further formed on the remote-control-device side release lever 85. The engagement piece 85*h* is formed so as to project from a central portion of the one lateral edge of the linear portion 85*a* and comes into engagement with the engagement piece 86*h* of the full-open lock lever 86 when the remote-control-device side release lever 85 turns about the support shaft 72 in the clockwise direction.

Figure 19:
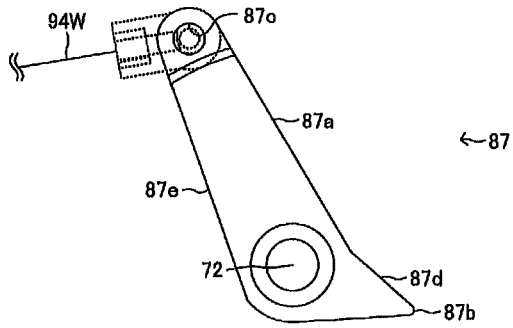
FIG. 19 A front view of a remote-control-device side cancel lever.

FIG. 19 is a front view of the remote-control-device side cancel lever 87. As illustrated in FIG. 19, the remote-control-device side cancel lever 87 includes a coupling piece 87*a* extending obliquely upward to the left in FIG. 19 from the support shaft 72 and an abutment piece 87*b* extending to the right in FIG. 19 from the support shaft 72. A through hole 87*c* is formed in the vicinity of a distal end of the coupling piece 87*a*. The cancel cable 94W is connected to the through hole 87*c*. As described above, the cancel cable 94W is connected to the cancel lever 47 provided to the rear-side door lock device 10B. Therefore, the remote-control-device side cancel lever 87 is connected to the cancel lever 47 through the cancel cable 94W. The remote-control-device side cancel lever 87 is biased by a spring in the counterclockwise direction in FIG. 12 and then abuts against a stopper (not shown) to be positioned at a position (original position) illustrated in FIG. 12.

The first engagement portion 87*d*, which comes into engagement with the first engagement portion 84*d* of the outside handle lever 84 when the outside handle lever 84 turns about the support shaft 72 in the clockwise direction, is formed on the abutment piece 87*b* of the remote-control-device side cancel lever 87. A second engagement piece 87*e*, which comes into engagement with the locking piece 83*a* of the inside handle lever 83 when the inside handle lever 83 turns about the support shaft 72 in the clockwise direction, is also formed on the coupling piece 87*a* of the remote-control-device side cancel lever 87.

Figure 20:
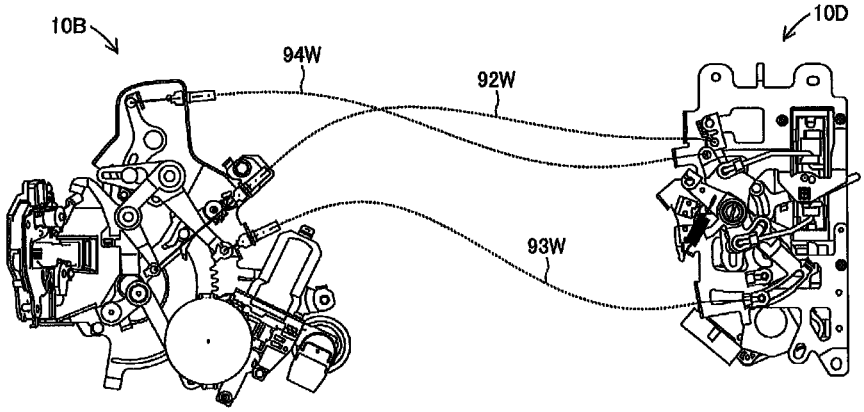
FIG. 20 A view illustrating a state in which the rear-side door lock device and the remote-control device are connected through cables 92W, 93W, and 94W.

Each of the door lock devices and the remote-control device 10D are configured as described above. FIG. 20 is a view illustrating a state in which the rear-side door lock device 10B and the remote-control device 10D are connected through the cables 92W, 93W, and 94W.

Next, an operation of the operation mechanism 80 is described. In the case where the closing operation for the inside handle 71 is performed when the sliding door 100 is locked at the fully-opened position by the full-open door lock device 10C, the full-open lock lever 86 is pushed by the rod 71*a* to turn about the support shaft 72 in the clockwise direction in FIG. 12. Then, the open cable 95W connected to the full-open lock lever 86 is pulled toward the remote-control device 10D, and hence the restriction on the latch in the latch-and-pawl mechanism of the full-open door lock device 100 is cancelled. Specifically, the lock of the sliding door 100 at the fully-opened position is released. As a result, the sliding door 100 can be slid in the closing direction.

In the case where the closing operation is performed for the outside handle 77 when the sliding door 100 is locked at the fully-opened position by the full-open door lock device 100, the outside handle lever 84 is pulled by the open cable 96W to turn in the clockwise direction in FIG. 12. Further, the remote-control-device side release lever 85 is pushed by the outside handle lever 84 to turn in the clockwise direction in FIG. 12. Then, the engagement piece 85*h* of the remote-control-device side release lever 85 comes into engagement with the engagement piece 86*h* of the full-open lock lever 86. As a result, the full-open lock lever 86 is pushed by the remote-control-device side release lever 85 to rotate about the support shaft 72 in the clockwise direction. Then, the open cable 95W is pulled toward the remote-control device 10D to release the lock of the sliding door 100 at the fully-opened position by the full-open door lock device 100.

In the case where a closing operation is performed, for example, on a remote-controller key or a door opening/closing button of the vehicle when the sliding door 100 is locked at the fully-opened position to the full-open door lock device 100, the electric motor 61 of the driving section 60 included in the rear-side door lock device 10B is actuated to rotate in a forward direction. As a result, the active lever 41 turns in the counterclockwise direction in FIG. 6A, and hence the abutment piece 41*b* of the active lever 41 abuts against the projecting portion 46*d* of the relay lever 46. When the electric motor 61 is actuated to further rotate in the forward direction in this state so that the active lever 41 turns in the counterclockwise direction, the relay lever 46 is pushed up by the abutment piece 41*b* to turn about the shaft center C3 in the clockwise direction in FIG. 6A. By the turning of the relay lever 46, the coupling pin 51 which is inserted through the cutout 46*a* formed in the relay lever 46 also turns in the clockwise direction. The coupling pin 51 is also inserted through the hole portion 45*c* formed through the release lever 45. Therefore, along with the turning of the coupling pin 51, the release lever 45 also turns in the clockwise direction. Specifically, the turning operation-force of the active lever 41 is transmitted to the release lever 45 through the relay lever 46 and the coupling pin 51, and hence the release lever 45 turns about the shaft center C3 in the clockwise direction.

By the turning of the release lever 45 in the clockwise direction, the release cable 93W is pulled toward the rear-side door lock device 10B. As a result, the remote-control-device side release lever 85 connected to the release lever 45 through the release cable 93W turns about the support shaft 72 in the clockwise direction in FIG. 12. Further, the engagement piece 85*h* of the remote-control-device side release lever 85 comes into engagement with the engagement piece 86*h* of the full-open lock lever 86, and hence the full-open lock lever 86 rotates about the support shaft 72 in the clockwise direction. Then, the open cable 95W is pulled toward the remote-control device 10D. As a result, the lock of the sliding door 100 at the fully-opened position by the full-open door lock device 10C is released.

In the case where the opening operation is performed for the inside handle 71 when the sliding door 100 is locked at the fully-closed position by the front-side door lock device 10A and the rear-side door lock device 10B, the inside handle lever 83 is pulled by the rod 71*b* to turn about the support shaft 72 in the clockwise direction. Along with the turning of the inside handle lever 83, the remote-control-device side cancel lever 87 engaged with the locking piece 83*a* at the second engagement piece 87*e* turns in the clockwise direction. When the child safety lock pin 53 is in the child-safety-unlock position, the locking lever 81 also turns in the clockwise direction along with the turning of the inside handle lever 83 in the clockwise direction. The turning of the locking lever 81 is transmitted to the remote-control-device side open lever 82 through the movable pin 52. As a result, the remote-control-device side open lever 82 turns in the clockwise direction. In this manner, the remote-control-device side open lever 82 is actuated in accordance with the operation of the inside handle 71.

By the turning of the remote-control-device side open lever 82 in the clockwise direction, the open cables 91W and 92W are pulled toward the remote-control device 10D. By the pull of the open cable 91W toward the remote-control device 10D, the restriction on the rotation of the latch 21 by the latch-and-pawl mechanism of the front-side door lock device 10A is cancelled. Moreover, by the pull of the open cable 92W toward the remote-control device 10D, the open lever 43 included in the rear-side door lock device 10B connected to the remote-control-device side open lever 82 through the open cable 92W turns about the shaft center C2 in the counterclockwise direction in FIG. 6. By the turning of the open lever 43 in the counterclockwise direction, the depressing piece 43*c* of the open lever 43 depresses the piece 23*a* to be depressed of the pawl-driving lever 23. By the depression of the piece 23*a* to be depressed of the pawl-driving lever 23, the pawl 22 rotates from the restricting position to the cancelling position. Therefore, the restriction on the turning of the latch 21 is cancelled. As a result, the lock of the sliding door 100 at the fully-closed position by the latch-and-pawl mechanisms of the front-side door lock device 10A and the rear-side door lock device 10B is released.

When the lock of the sliding door 100 at the fully-closed position is released by the opening operation for the inside handle 71, the occupant can quickly open the sliding door 100 while performing the opening operation for the inside handle 71. When the inside handle 71 is returned to the original position after the lock of the sliding door 100 is released by the opening operation for the inside handle 71, the electric motor 61 is actuated to rotate in the forward direction. By the actuation of the electric motor 61 for the rotation in the forward direction, the active lever 41 of the rear-side door lock device 10B turns in the counterclockwise direction so that the abutment piece 41*b* of the active lever 41 abuts against the projecting piece 46*d* of the relay lever 46. When the electric motor 61 is actuated to further rotate in the forward direction in this state so that the active lever 41 turns in the counterclockwise direction, the relay lever 46 is pushed up by the abutment piece 41*b* to turn about the shaft center C3 in the clockwise direction in FIG. 6. By the turning of the relay lever 46, the coupling pin 51 which is inserted through the cutout 46*a* formed in the relay lever 46 also turns in the clockwise direction. In this case, the coupling pin 51 is inserted through both the hole portion 45*c* of the release lever 45 and the cutout 46*a* of the relay lever 46. The release lever 45 is coupled to the relay lever 46 through the intermediation of the coupling pin 51. Therefore, along with the turning of the coupling pin 51, the release lever 45 also turns in the clockwise direction.

Figure 21:
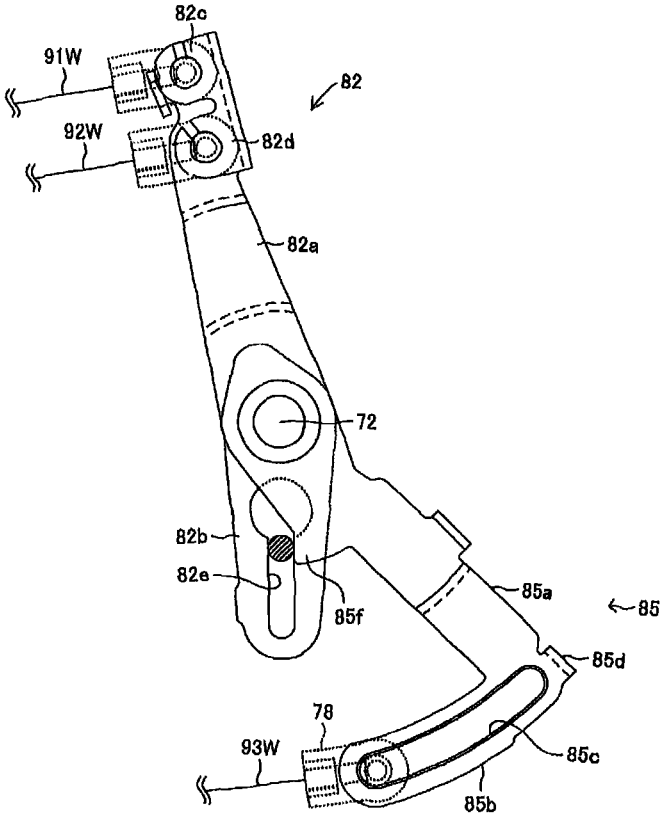
FIG. 21 A view illustrating a state in which the remote-control-device side release lever abuts against a movable pin.

By the turning of the release lever 45, the release cable 93W is pulled toward the rear-side door lock device 10B, and hence the remote-control-device side release lever 85 turns in the clockwise direction in FIG. 12. By the turning of the remote-control-device side release lever 85 in the clockwise direction, the projecting portion 85*f* formed on the remote-control-device side release lever 85 abuts against the movable pin 52 as illustrated in FIG. 21. By further turning of the remote-control-device side release lever 85 in the clockwise direction in this state, the movable pin 52 turns in the clockwise direction. The movable pin 52 is also inserted through the linear elongated hole 82*e* of the remote-control-device side open lever 82 as illustrated in FIG. 21. Therefore, along with the turning of the movable pin 52 in the clockwise direction, the remote-control-device side open lever 82 also turns in the clockwise direction. By the turning of the remote-control-device side open lever 82 in the clockwise direction, the open cables 91W and 92W are pulled toward the remote-control device 10D. Therefore, the lock of the sliding door 100 by the respective latch-and-pawl mechanisms of the front-side door lock device 10A and the rear-side door lock device 10B is released. As described above, after the opening operation for the inside handle 71 is terminated so that the inside handle lever 83 returns to the original position, the electric motor 61 is actuated to rotate in the forward direction. As a result, the lock of the sliding door 100 is released and the release of the lock of the sliding door 100 is maintained.

In the case where the opening operation is performed for the outside handle 77 when the sliding door 100 is locked at the fully-closed position by the front-side door lock device 10A and the rear-side door lock device 10B, the outside handle lever 84 is pulled by the open cable 96W. Therefore, the outside handle lever 84 turns about the support shaft 72 in the clockwise direction in FIG. 12. Along with the turning of the outside handle lever 84, the locking lever 81 engaged with the outside handle lever 84 at the engagement piece 81*h* and the remote-control-device side cancel lever 87 engaged with the first engagement portion 84*d* of the outside handle lever 84 at the first engagement portion 87*d* also turn in the clockwise direction in FIG. 12. The turning of the locking lever 81 is transmitted to the remote-control-device side open lever 82 through the movable pin 52, and hence the remote-control-device side open lever 82 turns in the clockwise direction. As described above, the remote-control-device side open lever 82 is actuated in accordance with the operation of the outside handle 77. By the turning of the remote-control-device side open lever 82 in the clockwise direction, the open cables 91W and 92W are pulled toward the remote-control device 10D. As a result, the lock of the sliding door 100 by the respective latch-and-pawl mechanisms of the forward-side door lock device 10A and the rear-side door lock device 10B is released.

When the lock of the sliding door 100 at the fully-closed position is released by the opening operation for the outside handle 77, the occupant can quickly open the sliding door 100 while performing the opening operation for the outside handle 77. When the outside handle 77 is returned to the original position after the lock of the sliding door 100 is released by the opening operation for the outside handle 77, the electric motor 61 is actuated to rotate in the forward direction. By the actuation of the electric motor 61 for the rotation in the forward direction, the active lever 41 of the rear-side door lock device 10B turns in the counterclockwise direction. Therefore, as described above, the turning operation-force of the active lever 41 is transmitted to the remote-control-device side release lever 85 through the relay lever 46, the coupling pin 51, the release lever 45, and the release cable 93W, and hence the remote-control-device side release lever 85 turns in the clockwise direction. By the turning of the remote-control-device side release lever 85 in the clockwise direction, the projecting portion 85*f* formed on the remote-control-device side release lever 85 abuts against the movable pin 52. By the further turning of the remote-control-device side release lever 85 in the clockwise direction in this state, the remote-control-device side open lever 82 having the linear elongated hole 82*e*, through which the movable pin 52 is inserted, turns in the clockwise direction to release the lock of the sliding door 100. As described above, after the opening operation for the outside handle 77 is terminated so that the outside handle lever 84 returns to the original position, the electric motor 61 is actuated to rotate in the forward direction. As a result, the lock of the sliding door 100 is released and the release of the lock of the sliding door 100 is maintained.

In the case where the opening operation is performed on, for example, the remote-controller key or the door opening/closing button of the vehicle when the sliding door 100 is locked at the fully-closed position by the front-side door lock device 10A and the rear-side door lock device 10B, the electric motor 61 of the driving section 60 included in the rear-side door lock device 10B is actuated to rotate in the forward direction. By the actuation of the electric motor 61 for the rotation in the forward direction, the active lever 41 of the rear-side door lock device 10B turns in the counterclockwise direction. As a result, as described above, the turning operation-force of the active lever 41 is transmitted to the remote-control-device side release lever 85 through the relay lever 46, the coupling pin 51, the release lever 45, and the release cable 93W, and hence the remote-control-device side release lever 85 turns in the clockwise direction. By the turning of the remote-control-device side release lever 85 in the clockwise direction, the projecting portion 85*f* formed on the remote-control-device side release lever 85 abuts against the movable pin 52. By further turning of the remote-control-device side release lever 85 in the clockwise direction in this state, the movable pin 52 turns about the support shaft 72 in the clockwise direction. The movable pin 52 is inserted through the linear elongated hole 82*e* of the remote-control-device side open lever 82 as described above. Therefore, along with the turning of the movable pin 52 in the clockwise direction, the remote-control-device side open lever 82 also turns about the support shaft 72 in the clockwise direction. By the turning of the remote-control-device side open lever 82 in the clockwise direction, the open cables 91W and 92W are pulled toward the remote-control device 10D. Therefore, the lock of the sliding door 100 by the respective latch-and-pawl mechanisms of the forward-side door lock device 10A and the rear-side door lock device 10B is released.

In the case where the pawl 22 of the rear-side door lock device 10B comes into engagement with the half-latch claw of the latch 21 when the sliding door 100 is closed, the open/close state of the sliding door 100 becomes a half-shut state. In this case, the sliding door 100 is locked by the front-side door lock device 10A and the rear-side door lock device 10B at a position in the vicinity of the fully-closed position. Whether or not the sliding door 100 is in the half-shut state is detected by a sensor or the like. A detection signal thereof is input to the door control device 104. When recognizing that the sliding door 100 is in the half-shut state, the door control device 104 outputs a driving command signal to the driving section 60 included in the rear-side door lock device 10B. In response to the driving command signal, the electric motor 61 of the driving section 60 is driven to rotate in a reverse direction. Along with the driving of the electric motor 61 for the rotation in the reverse direction, the active lever 41 turns in the clockwise direction in FIG. 6A. At this time, the abutment roller 42*d* abuts against the first abutment piece 44*a* of the positioning lever 44 to be supported by the positioning lever 44.

When the active lever 41 turns in the clockwise direction, the turning shaft 42*a* of the seesaw-type lever 42 moves upward. At this time, the abutment roller 42*d* is positioned. Therefore, the distal end portion of the first arm portion 42*b* of the seesaw-type lever 42 moves upward in FIG. 6A. In the case where the pawl 22 is engaged with the half-latch claw 21*b* of the latch 21, the leg portion 21*e* of the latch 21 is located above the first arm portion 42*b* of the seesaw-type lever 42 as illustrated in FIG. 4. Therefore, by the upward movement of the first arm portion 42*b*, the leg portion 21*e* of the latch 21 is pushed up. By the push-up of the leg portion 21*e*, the latch 21 rotates in the counterclockwise direction in FIG. 4. By the rotation of the latch 21 as described above, the full-latch claw of the latch 21 comes into engagement with the pawl 22. As a result, the open/close state of the sliding door 100 transits from the half-shut state to the fully-closed state. Specifically, the vehicle door opening/closing device of this embodiment includes an easy-closure mechanism for actuating the latch-and-pawl mechanisms by the power of the electric motor 61 through the intermediation of the seesaw-type lever 42 so that the sliding door is locked at the fully-closed position in the case where the sliding door 100 is locked at the position in the vicinity of the fully-closed position (is in the half-shut state).

By the way, when the electric motor 61 is actuated to rotate in the forward direction, the relay lever 46, the release lever 45, the remote-control-device side release lever 85, the remote-control-device side open lever 82, the open lever 43, and the like are actuated to rotate so as to cancel the restriction on the rotation of the latch 21 by the pawl 22 as described above. Therefore, the lock of the sliding door 100 by the door lock device is released. In the case where, for example, the electric motor 61 fails when the restriction on the rotation of the latch is cancelled by the actuation of the electric motor 61, the transition from the state in which the restriction on the rotation of the latch by the pawl is cancelled (release state) to the state in which the rotation of the latch is restricted by the pawl (that is, cancellation of the release state) cannot be performed. In such an emergency state (release emergency state), Japanese Patent Application Laid-open No. 2010-31569 discloses a vehicle door opening/closing device provided with a cancel-operation bar for blocking a power transmission path between the electric motor and a locking mechanism to cancel the release state. However, the cancel-operation bar is operated by inserting a tool from a through hole provided to a sliding door. Therefore, there is a problem in that the operation is cumbersome as well as difficult. In this embodiment, the vehicle door opening/closing device capable of cancelling the release state in the release emergency state by operating the inside handle or the outside handle is provided.

Figure 22A:
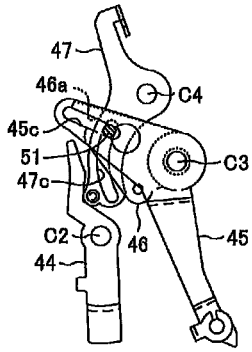
FIG. 22A A front view illustrating a relationship of arrangement among the positioning lever, the release lever, the relay lever, and the cancel lever in a release emergency state.

FIG. 22A is a front view illustrating a relationship of arrangement among the positioning lever 44, the release lever 45, the relay lever 46, and the cancel lever 47 in the release emergency state. As illustrated in FIG. 22A, in the release emergency state, the release lever 45 and the relay lever 46 in the state illustrated in FIG. 7 turn about the shaft center C3 in the clockwise direction.

When the opening operation is performed for the inside handle 71 in the release emergency state, the inside handle lever 83 included in the remote-control device 10D turns about the support shaft 72 in the clockwise direction. Along with the turning of the inside handle lever 83 in the clockwise direction, the remote-control-device side cancel lever 87 engaged with the locking piece 83*a* at the second engagement piece 87*e* also turns about the support shaft 72 in the clockwise direction as described above in association with the turning of the inside handle lever 83. By the turning of the remote-control-device side cancel lever 87 in the clockwise direction, the cancel cable 94W is pulled to the remote-control device 10D. Therefore, the cancel lever 47 of the rear-side door lock device 10B, which is connected to one end of the cancel cable 94W, turns about the shaft center C4 in the clockwise direction in FIG. 22A. That is, the cancel lever 47 is actuated (turned) in accordance with the opening operation for the inside handle 71.

Figure 22B:
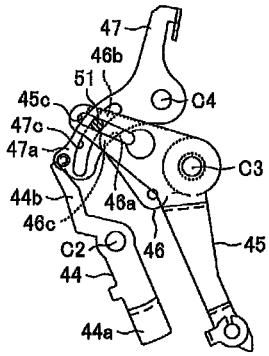
FIG. 22B A view illustrating a state in which a coupling pin moves in a direction away from a shaft center C3 along with turning of the cancel lever.

The coupling pin 51 is inserted into the arc-like elongated hole 47*c* formed in the cancel lever 47. The coupling pin 51 is simultaneously inserted through the cutout 46*a* of the relay lever 46 and the hole portion 45*c* of the release lever 45. Therefore, when the cancel lever 47 turns in the clockwise direction, the coupling pin 51 is subjected to a turning force of the cancel lever 47 from side walls forming the elongated hole 47*c* so as to slide inside the cutout 46*a* and the hole portion 45*c* in a direction away from the shaft center C3 while sliding inside the elongated hole 47*c*. FIG. 22B is a view illustrating a state in which the coupling pin 51 moves away from the shaft center C3 along with the turning of the cancel lever 47. As can be understood from the comparison between FIGS. 22A and 22B, the cancel lever 47 turns in the clockwise direction, and hence the coupling pin 51 slides inside the cutout 46*a* and the hole portion 45*c* so as to move away from the shaft center C3. By the turning of the cancel lever 47 in the clockwise direction, the first arm portion 47*a* of the cancel lever 47 abuts against the second abutment piece 44*b* of the positioning lever 44. By further turning of the cancel lever 47 in the clockwise direction in this state, the positioning lever 44 turns about the shaft center C2 in the counterclockwise direction. Thus, the first abutment piece 44*a* of the positioning lever 44 moves. When the first abutment piece 44*a* moves to the position illustrated in FIG. 22B, the abutment roller 42*d* does not abut against the positioning lever 44. Therefore, the abutment roller 42*d* is not positioned by the positioning lever 44.

In the case where the coupling pin 51 slides inside the cutout 46*a* and the hole portion 45*c* in the direction away from the shaft center C3 by the turning of the cancel lever 47, the coupling pin 51 and side walls forming the cutout 46*a* are then disengaged from each other, resulting in the removal of the coupling pin 51 from the cutout 46*a*. Specifically, the coupling pin 51 moves to a position at which the coupling pin abuts against the upper portion 46*b* of the relay lever 46 but does not abut against the lower portion 46*c*. More specifically, by the turning of the cancel lever 47, a state in which the coupling pin 51 is simultaneously inserted through the cutout 46*a*, the hole portion 45*c*, and the elongated hole 47*c* changes to a state in which the coupling pin 51 is inserted through the hole portion 45*c* and the elongated hole 47*c* but is not inserted through the cutout 46*a*.

When the coupling pin 51 is removed from the cutout 46*a*, the coupling between the relay lever 46 and the release lever 45 through the intermediation of the coupling pin 51 is interrupted. The relay lever 46 is connected to the electric motor 61 through the intermediation of the active lever 41. Moreover, the release lever 45 is connected to the remote-control-device side open lever 82 through the intermediation of the release cable 93W, the remote-control-device side release lever 85, and the movable pin 52. Therefore, by the turning of the cancel lever 47 in accordance with the operation of the inside handle 71, the connection between a member for transmitting the power of the electric motor 61 (power-transmission member) and the remote-control-device side open lever 82 (open mechanism) is interrupted. As a result, the transmission of the driving force of the electric motor 61 by the power-transmission member to the open mechanism is interrupted.

Figure 22C:
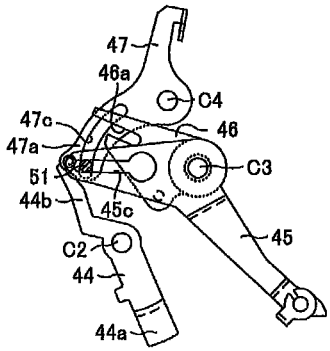
FIG. 22C A view illustrating a state in which the coupling pin is removed from a cutout so that the release lever returns to an original position.

When the coupling between the relay lever 46 and the release lever 45 is interrupted, the release lever 45 turns about the shaft center C3 in the counterclockwise direction by the biasing force of the spring to return to the original position. At this time, the coupling pin 51 also moves inside the hole portion 45*c* of the release lever 45 and the arc-like elongated hole 47*c* of the cancel lever 47 so as to follow the turning of the release lever 45 in the counterclockwise direction. On the other hand, the relay lever 46 is pushed up by the abutment piece 41*b* of the active lever 41, and therefore does not return to the original position. FIG. 22C is a view illustrating a state in which the coupling pin 51 is removed from the cutout 46*a* so that the release lever 45 returns to the original position.

When the release lever 45 returns to the original position, a tensile force from the release cable 93W, which is necessary to turn the remote-control-device side release lever 85 of the remote-control device 10D in the clockwise direction in FIG. 12, is lost. Therefore, the remote-control-device side release lever 85 turns in the counterclockwise direction by the biasing force of the spring to return to the original position. By the turning of the remote-control-device side release lever 85 in the counterclockwise direction, the remote-control-device side open lever 82, which is turned in the clockwise direction by the remote-control-device side release lever 85, also turns in the counterclockwise direction to return to the original position. As a result of the return of the remote-control-device side open lever 82 to the original position, the tensile force for pulling the open cables 91W and 92W to the remote-control device 10D is lost. Thus, the open levers 43 provided to the front-side door lock device 10A and the rear-side door lock device 10B return to the original positions, while the pawl-driving lever 23 is pushed up so that the pawl 22 returns to the restricting position for the latch 21. As a result, the release state is cancelled in the release emergency state.

When the opening operation is performed for the outside handle 77 in the release emergency state, the outside handle lever 84 is pulled by the open cable 96W to turn about the support shaft 72 in the clockwise direction in FIG. 12. When the outside handle lever 84 turns in the clockwise direction, the first engagement portion 87*d* of the remote-control-device side cancel lever 87 comes into engagement with the first engagement portion 84*d* of the outside handle lever 84. By the above-mentioned engagement, the remote-control-device side cancel lever 87 also turns in the clockwise direction in FIG. 12 in association with the turning of the outside handle lever 84. By the turning of the remote-control-device side cancel lever 87 in the clockwise direction, the cancel cable 94W is pulled to the remote-control device 10D. Therefore, the cancel lever 47 of the rear-side door lock device 10B, which is connected to one end of the cancel cable 94W, turns about the shaft center C4 in the clockwise direction in FIG. 22A. Specifically, the cancel lever 47 is actuated (turned) in accordance with the opening operation for the outside handle 77. A subsequent operation is as described for the case where the opening operation for the inside handle 71 is performed in the release emergency state described above, that is, each of the levers is actuated to cancel the release state. As described above, according to this embodiment, in the release emergency state, the release state can be easily cancelled by performing the opening operation for the inside handle 71 or the outside handle 77.

Figure 23A:
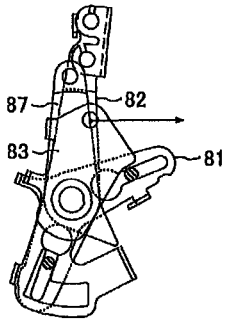
FIG. 23A A view illustrating a state in which the remote-control-device side cancel lever turns along with turning of the inside handle lever.
Figure 23B:
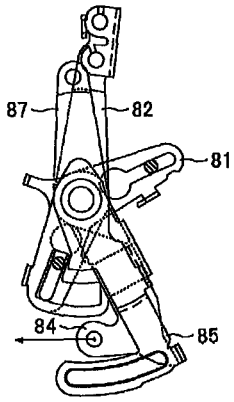
FIG. 23B A view illustrating a state in which the remote-control-device side cancel lever turns along with turning of the outside handle lever.
Figure 23C:
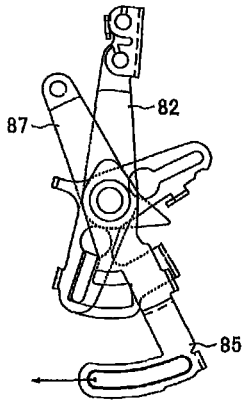
FIG. 23C A view illustrating a state in which the remote-control-device side release lever turns but the remote-control-device side cancel lever does not turn.

By the way, when the remote-control-device side release lever 85 turns about the support shaft 72 in the clockwise direction in FIG. 12 by the forward rotation of the electric motor 61, the remote-control-device side cancel lever 87 does not turn. Specifically, the remote-control-device side release lever 85 and the remote-control-device side cancel lever 87 do not rotate integrally. The forward rotation of the electric motor 61 is intended to release the lock of the sliding door by the latch-and-pawl mechanism, that is, to place the latch-and-pawl mechanism in the release state. Therefore, if the remote-control-device side cancel lever 87 turns when the electric motor 61 rotates in the forward direction for the purpose described above, the release state is disadvantageously cancelled. In order to avoid the contradiction described above, the remote-control-device side cancel lever 87 is configured to avoid rotating by the rotation of the remote-control-device side release lever 85. FIG. 23A is a view illustrating a state in which the remote-control-device side cancel lever 87 turns along with the turning of the inside handle lever 83. FIG. 23B is a view illustrating a state in which the remote-control-device side cancel lever 87 turns along with the turning of the outside handle lever 84. FIG. 23C is a view illustrating a state in which the remote-control-device side release lever 85 turns but the remote-control-device side cancel lever 87 does not turn.

Figure 24:
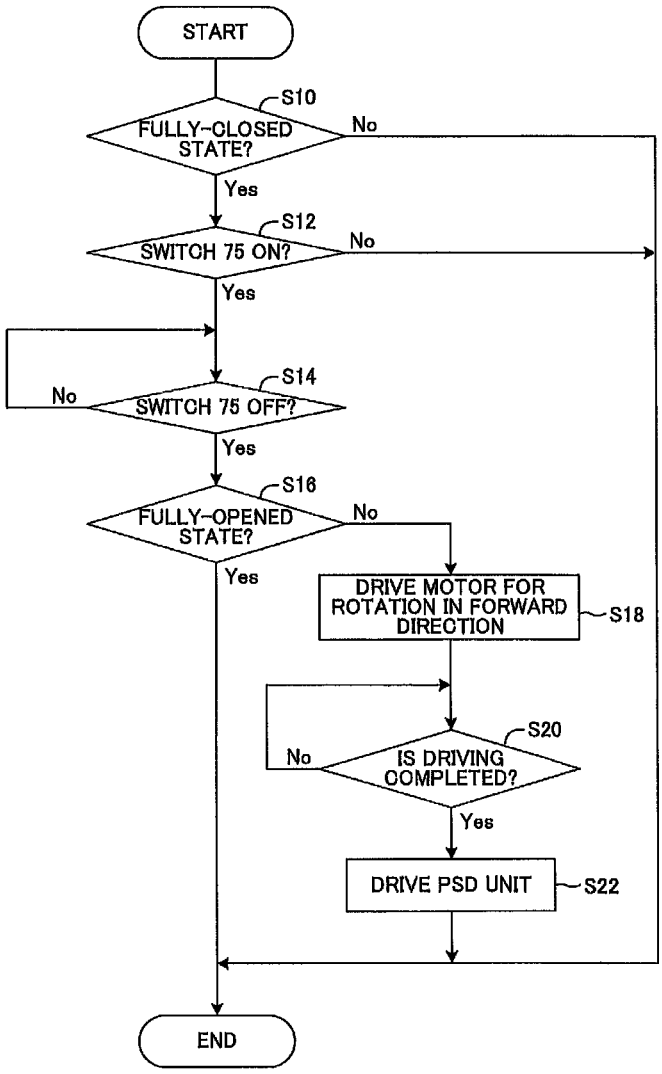
FIG. 24 A flowchart illustrating a flow of a door-opening/closing process executed by a door control device until the slide door is automatically opened.

In the case where the opening operation is performed for the inside handle 71 or the outside handle 77 when the sliding door 100 is locked at the fully-closed position by the latch-and-pawl mechanisms of the front-side door lock device 10A and the rear-side door lock device 10B, the restriction on the rotation of the latches by the pawls is cancelled as described above to release the lock of the sliding door. Thereafter, in the case where the inside handle 71 or the outside handle 77 is returned to the original position, the power sliding-door unit 105 is driven to automatically open the sliding door 100. FIG. 24 is a flowchart illustrating a flow of a door opening/closing process executed by the door control device 104 until the sliding door 100 is automatically opened by the power sliding-door unit 105. The process is repeatedly executed at predetermined short intervals after an ignition of the vehicle is placed in an ON state.

When the door opening/closing process is started, the door control device 104 first determines, in Step (hereinafter a step number is denoted with an abbreviation "S") 10 of FIG. 24, whether or not the sliding door 100 is locked at the fully-closed position by the front-side door lock device 10A and the rear-side door lock device 10B, that is, is in the fully-closed state. Whether or not the sliding door 100 is in the fully-closed state can be detected by, for example, a sensor provided to the vehicle main body 101. When the sliding door 100 is not in the fully-closed state (S10: No), the door control device 104 terminates the door opening/closing process in this step. On the other hand, when the sliding door 100 is in the fully-closed state (S10: Yes), the door control device 104 determines whether or not the switch 75 mounted to the remote-control device 10D is in an ON state (S12). A state of the switch 75 changes between the ON state and the OFF state depending on whether or not the opening operation is performed for the inside handle 71 or the outside handle 77. When the opening operation is performed for the inside handle 71 or the outside handle 77, the switch 75 is in the ON state. When the opening operation is not performed, the switch 75 is in the OFF state.

When the switch 75 is in the OFF state (S12: No), the door control device 104 terminates the door opening/closing process in this step. On the other hand, when the switch 75 is in the ON state (S12: Yes), specifically, the opening operation is performed for the inside handle 71 or the outside handle 77 while the sliding door 100 is locked at the fully-closed position so that the switch-depressing projecting piece 83*b* of the inside handle lever 83 or the switch-depressing projecting piece 81*g* of the locking lever 81 depresses the switch 75, the door control device 104 determines whether or not the state of the switch 75 has changed from the ON state to the OFF state (S14). When the state of the switch 75 has not changed from the ON state to the OFF state (S14: No), the door control device waits until the change occurs. When the state of the switch 75 has changed from the ON state to the OFF state (S14: Yes), the door control device 104 proceeds to S16.

In S16, it is determined whether or not the sliding door 100 is in the fully-opened state. Specifically, in S16, it is determined whether or not the occupant opens the sliding door 100 while performing the opening operation for the inside handle 71 or the outside handle 77 so that the sliding door 100 is locked at the fully-opened state. When the sliding door is in the fully-opened state (S16: Yes), the power sliding-door unit 105 is not required to be driven. Therefore, the door control device 104 terminates the door opening/closing process in this step. On the other hand, when the sliding door is not in the fully-opened state (S16: No), the door control device 104 outputs a command signal to the driving section 60 so that the electric motor 61 is driven to rotate in the forward direction (S18). Specifically, after confirming that the switch 75 is placed in the ON state and then is placed in the OFF state, the door control device 104 drives the electric motor 61 to rotate in the forward direction.

Next, the door control device 104 determines whether or not the driving of the electric motor 61 is completed (S20) and outputs a signal for driving the power sliding-door unit 105 after the completion of the driving (S22). As a result, the power sliding-door unit 105 starts the driving to open the sliding door 100. Thereafter, the door control device 104 terminates the door opening/closing process in this step.

As described above, according to the door opening/closing process of this embodiment, after it is confirmed that the state of the switch 75 has changed from the ON state to the OFF state, the power sliding-door unit 105 is driven.

Figure 25:
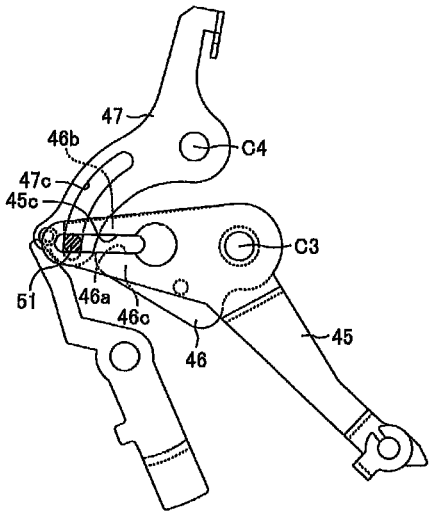
FIG. 25 A view illustrating a relationship of arrangement among the release lever, the relay lever, and the cancel lever when a switch 75 is in an ON state.

FIG. 25 is a view illustrating a relationship of arrangement among the release lever 45, the relay lever 46, and the cancel lever 47 when the switch 75 is in the ON state. When the switch 75 is in the ON state, the opening operation is performed for the inside handle 71 or the outside handle 77. By the opening operation for the inside handle 71 or the outside handle 77, the remote-control-device side open lever 82 turns in the clockwise direction in FIG. 12. Further, the remote-control-device side cancel lever 87 also turns in the clockwise direction. When the remote-control-device side cancel lever 87 turns in the clockwise direction, the cancel cable 94W is pulled toward the remote-control device 10D. As a result, the cancel lever 47 of the rear-side door lock device 10B turns in the clockwise direction in FIG. 6A. The coupling pin 51 is inserted through the arc-like elongated hole 47*c* formed in the cancel lever 47. The coupling pin 51 is simultaneously inserted through the hole portion 45*c* of the release lever 45 and the cutout 46*a* of the relay lever 46 as described above. Therefore, when the cancel lever 47 turns in the clockwise direction, the coupling pin 51 is subjected to the turning force of the cancel lever 47 from the side walls forming the elongated hole 47*c* so as to slide inside the hole portion 45*c* of the release lever 45 and the cutout 46*a* of the relay lever 46 in the direction away from the shaft center C3 while sliding inside the elongated hole 47*c*. Then, as illustrated in FIG. 25, the coupling pin 51 slides to the vicinity of a left end of the hole portion 45*c* of the release lever 45.

When the coupling pin 51 slides to the position illustrated in FIG. 25, the coupling pin 51 is removed from the cutout 46*a* of the relay lever 46. Specifically, among the upper portion 46*b* and the lower portion 46*c* formed respectively above and below the cutout 46*a* of the relay lever 46, the coupling pin 51 is engaged with the upper portion 46*b* but is not engaged with the lower portion 46*c*.

Figure 26:
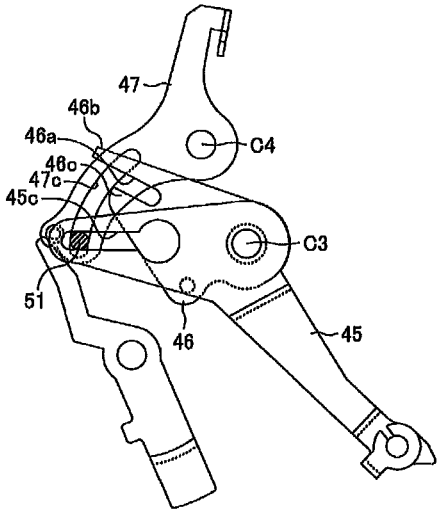
FIG. 26 A view illustrating a state in which the relay lever turns alone when the coupling pin is removed from the cutout.

Therefore, in the case where the electric motor 61 is rotated in the forward direction when the coupling pin 51 is located at the position illustrated in FIG. 25, the coupling pin 51 is removed from the cutout 46*a* of the relay lever 46, and hence the relay lever 46 turns alone and the turning thereof is not transmitted to the release lever 45 through the coupling pin 51 even when the relay lever 46 turns in the clockwise direction through the intermediation of the active lever 41. FIG. 26 is a view illustrating a state in which the relay lever 46 turns alone when the coupling pin 51 is removed from the cutout 46*a*.

In the case where the relay lever 46 turns alone and the turning thereof is not transmitted to the release lever 45 as illustrated in FIG. 26, the release lever 45 does not turn. Therefore, the release of the lock of the sliding door 100 by the driving of the electric motor 61 for the rotation in the forward direction is not achieved.

For driving the power sliding-door unit 105, the lock of the sliding door 100 by the latch-and-pawl mechanisms of the door lock devices is required to be released. Specifically, it is required that no restriction be placed on the rotation of the latch by the pawl. When the lock of the sliding door 100 is released by the opening operation for the inside handle 71 or the outside handle 77, the sliding door 100 moves by an elastic force of a sealing rubber or the like for sealing the sliding door to the door frame. As a result, the striker engaged with the latch is removed from the striker-receiving groove. Therefore, the engagement between the latch and the striker is released, and hence the latch turns to the cancelling position. When the latch turns to the cancelling position, the rotation of the latch 21 is not restricted even when the pawl 22 is located at the restricting position as illustrated in FIG. 3.

However, in the case where the sliding door 100 cannot be moved due to freezing or the like even when the lock of the sliding door 100 is attempted to be released by the opening operation for the inside handle 71 or the outside handle 77, the striker cannot be removed from the striker-receiving groove. When the inside handle 71 or the outside handle 77 is returned to the original position in this state, the pawl 22 restricts the rotation of the latch 21 again. Specifically, only by performing the opening operation for the inside handle 71 or the outside handle 77, it cannot be ensured that the lock of the sliding door 100 is reliably released.

In order to reliably ensure the release of the lock of the sliding door 100, the electric motor 61 is required to be driven so as to maintain the pawl at the cancelling position (position indicated by a dotted line in FIG. 5) after the inside handle 71 or the outside handle 77 is operated. In this embodiment, however, in the case where the electric motor 61 is driven when the switch 75 is in the ON state (specifically, the opening operation is performed for the inside handle 71 or the outside handle 77), the relay lever 46 turns alone as illustrated in FIG. 26 and the turning thereof is not transmitted to the release lever 45. Therefore, the release lever 45 does not turn, and as a result, the release of the lock of the sliding door 100 by the driving of the electric motor 61 is not achieved.

Therefore, in this embodiment, in the case where the switch 75 is in the ON state (in the case where the opening operation is performed for the inside handle 71 or the outside handle 77), the driving motor 61 is driven after it is confirmed that the state of the switch 75 is subsequently changed to the OFF state (the inside handle 71 or the outside handle 77 is returned to the original position).

Figure 27:
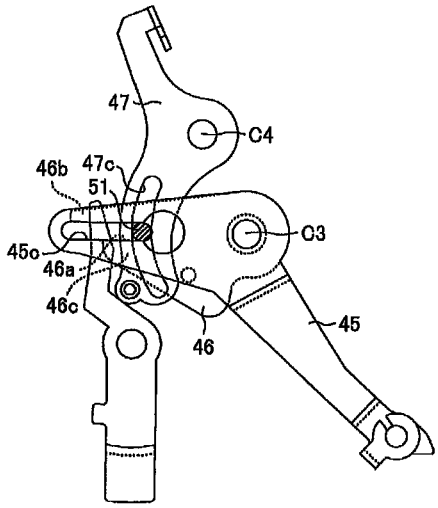
FIG. 27 A view illustrating a relationship of arrangement among the release lever, the relay lever, and the cancel lever when the switch 75 is in an OFF state.
Figure 28:
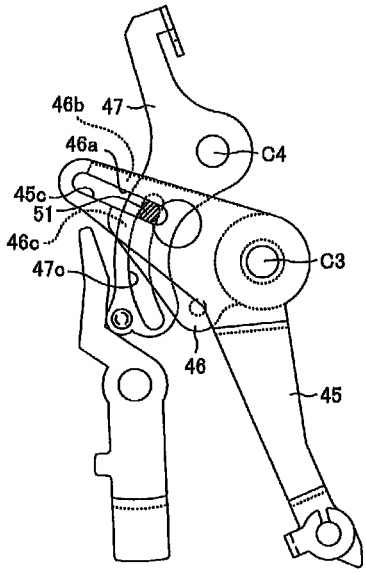
FIG. 28 A view illustrating a state in which the release lever turns together with the relay lever.

FIG. 27 is a view illustrating a relationship of arrangement among the release lever 45, the relay lever 46, and the cancel lever 47 when the switch 75 is in the OFF state. As illustrated in FIG. 27, when the switch 75 is in the OFF state, the coupling pin 51 is located at a position inside the hole portion 45*c* of the release lever 45, which is on the side close to the shaft center C3. At this position, the coupling pin 51 is inserted through both the hole portion 45*c* of the release lever 45 and the cutout 46*a* of the relay lever 46, and hence the release lever 45 is coupled to the relay lever 46 through the intermediation of the coupling pin 51. Therefore, when the electric motor 61 is driven, the release lever 45 turns together with the relay lever 46. FIG. 28 is a view illustrating a state in which the release lever 45 turns together with the relay lever 46.

As described above, by the turning of the release lever 45 in the clockwise direction together with the relay lever 46, the turning operation-force of the active lever 41 is transmitted to the remote-control-device side release lever 85 through the release cable 93W to turn the remote-control-device side release lever 85 in the clockwise direction. By the turning of the remote-control-device side release lever 85 in the clockwise direction, the projecting portion 85*f* formed on the remote-control-device side release lever 85 abuts against the movable pin 52. By the further turning of the remote-control-device side release lever 85 in the clockwise direction in this state, the remote-control-device side open lever 82 having the linear elongated hole 82*e*, through which the movable pin 52 is inserted, turns in the clockwise direction. Therefore, a state in which the open lever 43 depresses the pawl-driving lever 23 is maintained. The state in which the pawl-driving lever 23 is depressed is a state in which the pawl 22 is turned to the cancelling position. Thus, the rotation of the latch 21 is not restricted by the pawl 22. Specifically, the release of the lock of the sliding door 100 is reliably ensured. By driving the power sliding-door unit 105 in this state, the sliding door 100 can be quickly opened.

This embodiment has been described above. In this embodiment, the latch-and-pawl mechanism 20 corresponds to a locking mechanism. The open lever 43, the open cable 92W, and the remote-control-device side open lever 82 correspond to an open mechanism. The electric motor 61, the active lever 41, the relay lever 46, the release lever 45, the coupled pin 51, the release cable 93W, and the remote-control-device side release lever 85 correspond to a release mechanism. The cancel lever 47, the cancel cable 94W, and the remote-control-device side cancel lever 87 correspond to a cancel mechanism.

The vehicle door opening/closing device of this embodiment includes the inside handle 71 adapted to be mounted to the sliding door 100 and adapted to be operated from the vehicle interior when the opening/closing operation is to be performed for the sliding door 100, the outside handle 77 adapted to be mounted to the sliding door 100 and adapted to be operated from the vehicle exterior when the opening/closing operation is to be performed for the sliding door 100, the latch-and-pawl mechanism 20 adapted to be actuated to lock the sliding door 100 at the predetermined open/close position (fully-closed position or fully-opened position), the open mechanism (the open lever 43, the open cable 92W, and the remote-control-device side open lever 82) adapted to be actuated in accordance with the operation of the inside handle 71 and the operation of the outside handle 77 to release the lock of the sliding door 100 by the latch-and-pawl mechanism 20, the release mechanism including the electric motor 61 and the power-transmission member for transmitting the power of the electric motor 61 to the open mechanism, the release mechanism being adapted to actuate the open mechanism by the driving force of the electric motor 61 to release the lock of the sliding door 100, and the cancel mechanism (the cancel lever 47 and the remote-control-device side cancel lever 87) to be actuated in accordance with the operation of the inside handle 71 and the operation of the outside handle 77 to interrupt the transmission of the driving force of the electric motor 61 to the open mechanism by the power-transmission member.

Moreover, the power-transmission member includes the active lever 41 connected to the electric motor 61 so as to be turned by the power of the electric motor 61, the relay lever 46 capable of abutting against the active lever 41, the relay lever 46 being turned by the active lever 41, the release lever 45 turnably connected to the open mechanism (remote-control-device side open lever 82) through the link member such as the release cable 93W and the remote-control-device side release lever 85, and the coupling pin 51 coupled to the release lever 45 and coupled to the relay lever 46 so as to be removable therefrom. Moreover, the cancel mechanism includes the cancel lever 47 to be turned in accordance with the operation of the inside handle 71 and the operation of the outside handle 77 to remove the coupling pin 51 from the relay lever 46.

Moreover, the vehicle door opening/closing device of this embodiment includes the door lock device 10B including the locking mechanism (pawl and latch mechanism 20), and the remote-control device 10D for transmitting the operation power of the inside handle 71 and the operation power of the outside handle 77 to the door lock device. The open mechanism includes the open lever 43 provided turnably on the second base board 11B of the door lock device 10B and adapted to be turned to release the lock of the sliding door 100 by the locking mechanism, and the remote-control-device side open lever 82 provided turnably on the base board 70 of the remote-control device 10D and connected to the open lever 43 through the intermediation of the connection member such as the open cable 92W, the remote-control-device side open lever 82 being turned in accordance with the operation of the inside handle 71 and the operation of the outside handle 77. The release mechanism includes the electric motor 61 mounted onto the second base board 11B of the door lock device 10B, the active lever 41, the relay lever 46, and the release lever 45 provided turnably to the door lock device 10B, and the remote-control-device side release lever 85 provided turnably to the remote-control device 10D, connected to the release lever 45 through the connection member such as the release cable 93W, and configured to be capable of turning the remote-control-device side open lever 82 by the turning thereof. The cancel mechanism includes the cancel lever 47 provided turnably onto the second base board 11B of the door lock device 10B, and the remote-control-device side cancel lever 87 provided turnably to the remote-control device 10D and connected to the cancel lever 47 through the connection member such as the cancel cable 94W, the remote-control-device side cancel lever 87 being turned in accordance with the operation of the inside handle 71 and the operation of the outside handle 77.

Further, in the vehicle door opening/closing device of this embodiment, the remote-control device 10D includes the inside handle lever 83 connected to the inside handle 71, the inside handle lever 83 being turned in association with the operation of the inside handle 71, and the outside handle lever 84 connected to the outside handle 77, the outside handle lever 84 being turned in association with the operation of the outside handle 77. The remote-control-device side cancel lever 87 is configured to be turned in association with the turning of the inside handle lever 83 and the turning of the outside handle lever 84 and to avoid being turned in association with the turning of the remote-control-device side release lever 85.

According to the vehicle door opening/closing device of this embodiment, by performing the opening operation for the inside handle 71 or the outside handle 77 in the release emergency state, the cancel lever 47 is turned, and hence the coupling pin 51, which connects the relay lever 46 and the release lever 45 to each other, is removed from the cutout 46*a* of the relay lever 46. Therefore, the connection between the member on the side of the relay lever 46 and the open mechanism connected to the release lever 45 is interrupted to interrupt the transmission of the driving force of the electric motor 61 through the power-transmission member to the open mechanism. By the separation of the open mechanism from the electric motor 61 as described above, the open mechanism returns to the original position. Therefore, by a simple method in which the occupant operates the inside handle 71 or the outside handle 77 in the release emergency state, the release state can be cancelled.

Further, when the sliding door 100 is locked in the half-shut state at the position in the vicinity of the fully-closed position by the latch-and-pawl mechanism 20, the electric motor 61 is actuated to rotate in the reverse direction (actuated for closure) so that the sliding door 100 is locked at the fully-closed position by the latch-and-pawl mechanism 20. The vehicle door opening/closing device of this embodiment includes the seesaw-type lever 42 (driving lever) for transmitting the power generated by the actuation of the electric motor 61 for closure to the latch-and-pawl mechanism 20. Therefore, the latch-and-pawl mechanism 20 is actuated through the seesaw-type lever 42, and hence the sliding door 100 is locked at the fully-closed position. Specifically, the vehicle door opening/closing device of this embodiment includes the easy closure mechanism. Therefore, even when the sliding door 100 is in the half-shut state, the sliding door 100 can be automatically locked at the fully-closed position.

The vehicle door opening/closing device of this embodiment further includes the positioning lever (support lever) 44 for positioning and supporting the seesaw-type lever 42 so that the seesaw-type lever 42 can transmit the power generated by the actuation of the electric motor 61 for closure to the latch-and-pawl mechanism 20. When the seesaw-type lever 42 is supported by the positioning lever 44, the seesaw-type lever 42 can transmit the power generated by the actuation of the electric motor 61 for closure to the latch-and-pawl mechanism 20. Moreover, the positioning lever 44 turns about the support shaft C2 in the counterclockwise direction by the turning of the cancel mechanism (cancel lever 47) as illustrated in FIG. 22B. When the positioning lever 44 turns, the abutment roller 42*d* mounted to the seesaw-type lever 42 does not abut against the abutment piece 44*a* of the positioning lever 44. Therefore, the seesaw-type lever 42 is not positioned by the positioning lever 44. Thus, the seesaw-type lever 42 cannot transmit the power of the electric motor 61 to the latch-and-pawl mechanism 20. Specifically, the positioning lever 44 is configured to be actuated in association with the actuation of the cancel mechanism to cancel the support for the seesaw-type lever 42.

The cancel mechanism (cancel lever 47) is actuated (turned) by operating the inside handle 71 or the outside handle 77 as described above. Therefore, by operating the inside handle 71 or the outside handle 77, the positioning and support for the seesaw-type lever 42 by the positioning lever 44 is cancelled.

Specifically, according to this embodiment, when the open/close state of the sliding door 100 transits from the half-shut state to the fully-closed state by the power generated by the actuation of the electric motor 61 for closure, the transmission of the power of the electric motor 61 to the latch-and-pawl mechanism 20 can be easily interrupted by operating the inside handle 71 or the outside handle 77 to release the engagement (abutment) between the positioning lever 44 and the abutment roller 42*d*.

Moreover, according to this embodiment, after the inside handle 71 or the outside handle 77 is operated (the switch 75 is placed in the ON state) and the inside handle 71 or the outside handle 77 is then returned to the original position (the state of the switch 75 changes to the OFF state), the electric motor 61 is actuated to rotate in the forward direction (actuated for release). By actuating the electric motor 61 after the confirmation of ON/OFF of the switch, the lock of the sliding door 100 can be reliably released as described above.

If the power sliding-door unit 105 is actuated to move the sliding door 100 when the occupant is manually operating the inside handle 71 or the outside handle 77, a hand, which performs the manual operation, is pulled by the operation of the sliding door 100 to sometimes feel discomfort. Further, if the power sliding-door unit 105 is actuated immediately after the manual operation, the sliding door 100 opens slowly in accordance with the actuation of the power sliding-door unit 105. Therefore, the intension of the occupant to quickly open the sliding door 100 cannot be reflected. In contrast, in this embodiment, the occupant manually operates the inside handle 71 or the outside handle 77 and then, for example, releases the inside handle 71 or the outside handle 77 after the termination of the operation. As a result, after the inside handle 71 or the outside handle 77 returns to the original position, the electric motor 61 is actuated to release the lock of the sliding door 100. Thereafter, the power sliding-door unit 105 is driven. The power sliding-door unit 105 is not actuated immediately after the manual operation. Thus, the hand which performs the manual operation is not pulled by the operation of the sliding door 100. When the occupant desires to quickly open the sliding door 100, the occupant only needs to directly open the sliding door 100. In this case, the return of the inside handle 71 or the outside handle 77 to the original position is not recognized (specifically, the change of the state of the switch 75 to the OFF state is not recognized). Thus, the power sliding-door unit 105 is not actuated.

Moreover, according to the vehicle door opening/closing device of this embodiment, by the turning of the cancel lever 47, the release state is cancelled (release cancel) in the release emergency state. At the same time, by the turning of the cancel lever 47, the positioning lever 44 and the abutment roller 42*d* are disengaged, and hence the transmission of the power of the electric motor 61 by the actuation for closure to the latch-and-pawl mechanism 20 is interrupted (closure cancel). Specifically, the release cancel in the release emergency state and the closure cancel are realized by the single lever. Therefore, as compared with the case where a cancel lever for release cancel and a cancel lever for closure cancel are respectively provided, cost is reduced while the door lock device can be configured in a simple manner.

Although the embodiment of the present invention has been described above, the present invention should not be limited to the embodiment described above. For example, the opening/closing device for the sliding door has been described in the embodiment described above. However, the present invention can be applied to a door using other opening/closing methods. Moreover, the example where the sliding door is locked by the latch-and-pawl mechanism has been described in the embodiment described above. However, the present invention can be applied even to the case where the sliding door is locked by other methods. As described above, the present invention can be modified without departing from the scope of the invention.

The invention claimed is:

1. A vehicle door opening/closing device, comprising:

an inside handle adapted to be mounted to a door of a vehicle and adapted to be operated from a vehicle interior when an opening/closing operation is to be performed for the door;

an outside handle adapted to be mounted to the door and adapted to be operated from a vehicle exterior when the opening/closing operation is to be performed for the door;

a locking mechanism adapted to be actuated to lock the door at a predetermined open/close position;

an open mechanism adapted to be actuated in accordance with an operation of the inside handle and an operation of the outside handle to release the lock of the door by the locking mechanism;

a release mechanism including an electric motor and a power-transmission member for transmitting power of the electric motor to the open mechanism, the release mechanism being adapted to actuate the open mechanism by a driving force of the electric motor to release the lock of the door;

a cancel mechanism to be actuated in accordance with the operation of the inside handle and the operation of the outside handle to interrupt transmission of the driving force of the electric motor to the open mechanism by the power-transmission member, wherein the power-transmission member includes an active lever connected to the electric motor so as to be turned by the power of the electric motor, a relay lever capable of abutting against the active lever, the relay lever being turned by the active lever, a release lever turnably connected to the open mechanism, and a coupling member coupled to the release lever and coupled to the relay lever so as to be removable therefrom, the cancel mechanism includes a cancel lever to be turned in accordance with the operation of the inside handle and the operation of the outside handle to remove the coupling member from the relay lever, a door lock device including the locking mechanism, a remote-control device for transmitting operation power of the inside handle and operation power of the outside handle to the door lock device, wherein:

the open mechanism includes:

an open lever provided turnably to the door lock device and adapted to be turned to release the lock of the door by the locking mechanism;

a remote-control-device side open lever provided turnably to the remote-control device and connected to the open lever, the remote-control-device side open lever being turned in accordance with the operation of the inside handle and the operation of the outside handle;

the release mechanism includes the electric motor mounted to the door lock device, the active lever, the relay lever, and the release lever provided turnably to the door lock device, and a remote-control-device side release lever provided turnably to the remote-control device, connected to the release lever, and configured to be capable of turning the remote-control-device side open lever by turning thereof;

the cancel mechanism includes the cancel lever provided turnably to the door lock device, and a remote-control-device side cancel lever provided turnably to the remote-control device and connected to the cancel lever, the remote-control-device side cancel lever being turned in accordance with the operation of the inside handle and the operation of the outside handle, wherein the remote-control device includes:

an inside handle lever connected to the inside handle, the inside handle lever being turned in association with the operation of the inside handle;

an outside handle lever connected to the outside handle, the outside handle lever being turned in association with the operation of the outside handle; and the remote-control-device side cancel lever is configured to be turned in association with the turning of the inside handle lever and the turning of the outside handle lever and to avoid being turned in association with the turning of the remote-control-device side release lever.

2. A vehicle door opening/closing device according to claim 1, further comprising a driving lever adapted to actuate the locking mechanism by the power of the electric motor so that the door is locked at a fully-closed position or a fully-opened position by the locking mechanism when the door is locked at a position in vicinity of the fully-closed position or a position in vicinity of the fully-opened position by the locking mechanism.

3. A vehicle door opening/closing device according to claim 2, further comprising a support lever for supporting the driving lever so that the driving lever is capable of transmitting the power of the electric motor to the locking mechanism, wherein the support lever is configured to be actuated in association with actuation of the cancel mechanism to cancel the support for the driving lever.

4. A vehicle door opening/closing device according to claim 1, further comprising a driving lever adapted to actuate the locking mechanism by the power of the electric motor so that the door is locked at a fully-closed position or a fully-opened position by the locking mechanism when the door is locked at a position in vicinity of the fully-closed position or a position in vicinity of the fully-opened position by the locking mechanism.

5. A vehicle door opening/closing device according to claim 4, further comprising a support lever for supporting the driving lever so that the driving lever is capable of transmitting the power of the electric motor to the locking mechanism, wherein the support lever is configured to be actuated in association with actuation of the cancel mechanism to cancel the support for the driving lever.

6. A vehicle door opening/closing device according to claim 1, wherein:

the door lock device further comprises:

a driving lever adapted to actuate the locking mechanism by the power of the electric motor so that the door is locked at a fully-closed position or a fully-opened position by the locking mechanism when the door is locked at a position in vicinity of the fully-closed position or a position in vicinity of the fully-opened position by the locking mechanism; and a support lever for supporting the driving lever so that the driving lever is capable of transmitting the power of the electric motor to the locking mechanism; and the support lever is configured to be actuated in association with actuation of the cancel lever to cancel the support for the driving lever.

7. A vehicle door opening/closing device, comprising:

an inside handle adapted to be mounted to a door of a vehicle and adapted to be operated from a vehicle interior when an opening/closing operation is to be performed for the door;

an outside handle adapted to be mounted to the door and adapted to be operated from a vehicle exterior when the opening/closing operation is to be performed for the door;

a door lock device including a locking mechanism adapted to be actuated to lock the door at a predetermined open/close position;

a remote-control device for transmitting operation power of the inside handle and operation power of the outside handle to the door lock device;

an open mechanism adapted to be actuated in accordance with an operation of the inside handle and an operation of the outside handle to release the lock of the door by the locking mechanism;

a release mechanism including:

an electric motor;

an active lever connected to the electric motor so as to be turned by the power of the electric motor;

a relay lever capable, of abutting against the active lever and being turned by the active lever;

a release lever turnably connected to the open mechanism;

a coupling member coupled to the release lever and coupled to the relay lever so as to be removable therefrom;

a remote-control-device side release lever provided turnably to the remote-control device and connected to the release lever, wherein the release mechanism being adapted to actuate the open mechanism by a driving force of the electric motor to release the lock of the door; and a cancel mechanism including:

a remote-control-device side cancel lever provided turnably to the remote-control device, the remote-control-device side cancel lever being configured to be turned in association with the operation of the inside handle and the operation of the outside handle and to avoid being turned in association with the turning of the remote-control-device side release lever, and a cancel lever connected to the remote-control side cancel lever and turned in accordance with turning of the remote-control-device side cancel lever to remove the coupling member from the relay member.

* * * * *